US010933671B2

(12) United States Patent
Shimomura

(10) Patent No.: US 10,933,671 B2
(45) Date of Patent: Mar. 2, 2021

(54) PRINTING APPARATUS

(71) Applicant: SEIKO EPSON CORPORATION, Tokyo (JP)

(72) Inventor: Masaki Shimomura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/693,846

(22) Filed: Nov. 25, 2019

(65) Prior Publication Data

US 2020/0171864 A1 Jun. 4, 2020

(30) Foreign Application Priority Data

Nov. 29, 2018 (JP) ..... JP2018-223237

(51) Int. Cl.
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS

2006/0056901 A1* 3/2006 Shiraishi ..... B65H 1/266 400/625
2018/0178569 A1 6/2018 Tamai

FOREIGN PATENT DOCUMENTS

JP H08-339240 A 12/1996
JP 2018-103528 A 7/2018

* cited by examiner

*Primary Examiner* — Erica S Lin
(74) *Attorney, Agent, or Firm* — Workman Nydegger

(57) ABSTRACT

A locking mechanism in a printing apparatus includes a slide member inside an outer casing at a position corresponding to an opening in an outer casing of the printing apparatus, the slide member being configured to be moved in a slide direction to switch a state of an access cover between a locked state and an unlocked state, and a restriction portion configured to be moved in the slide direction together with the slide member, in which when the slide member is in a lock position, the restriction portion protrudes from the opening and the movement in the slide direction is regulated, when the slide member is in an unlock position, the restriction portion is retracted inside the opening and the movement in the slide direction is permitted, and the restriction portion includes an operation portion configured to move the slide member between the lock position and the unlock position.

8 Claims, 23 Drawing Sheets

PRINTING APPARATUS

The present application is based on, and claims priority from JP Application Serial Number 2018-223237, filed Nov. 29, 2018, the disclosure of which is hereby incorporated by reference herein in its entirety.

BACKGROUND

1. Technical Field

The present disclosure relates to a printing apparatus such as an ink jet printer.

2. Related Art

An ink jet printer having an access cover openable to replace print-related components such as an ink pack in the apparatus is described in JP-A-2018-103528. The printer includes a locking mechanism for the access cover. The locking mechanism has a movable member that can be moved between a lock position and an unlock position. Specifically, the movable member has a curved shape and is disposed at a corner portion of the apparatus. In a locking operation, a finger placing portion of the movable member is pressed in a locking direction to locate the movable member to a lock position and the finger placing portion is pressed in an unlocking direction to locate the movable member to an unlock position.

In the printer described in JP-A-2018-103528, the movable member in the locking mechanism has the curved shape and is disposed at the corner portion of the apparatus. However, the locking mechanism is not designed to be provided at a place other than the corner portion. Furthermore, when the movable member is located in the lock position, if the finger placing portion of the movable member is pressed in the unlocking direction, the movable member is moved in the unlock direction. Accordingly, in the locked state, if the finger placing portion is inadvertently pressed in the unlock direction, the movable member may be turned to the unlocked state.

SUMMARY

A printing apparatus according to a first aspect of the present disclosure for solving the above-described problems includes an insertion slot to which a container containing a print-related component relating to printing performed by a print section is to be detachably attached, an access cover openably and closably covering the insertion slots, and a locking mechanism configured to lock the access cover. The locking mechanism includes a slide member disposed inside an outer casing at a position corresponding to an opening provided in the outer casing of the printing apparatus, the slide member being configured to be moved in a slide direction to switch a state of the access cover between a locked state and an unlocked state, and a restriction portion configured to be moved in the slide direction together with the slide member. In a state in which the slide member is in a lock position on one end side of the opening in the slide direction, the restriction portion protrudes from the opening and the movement in the slide direction is regulated, in a state in which the slide member is in an unlock position on the other end side of the opening in the slide direction, the restriction portion is retracted inside the opening and the movement in the slide direction is permitted, and the restriction portion includes an operation portion configured to move the slide member from the outside of the opening between the lock position and the unlock position.

DESCRIPTION OF EXEMPLARY EMBODIMENTS

Figure 1:
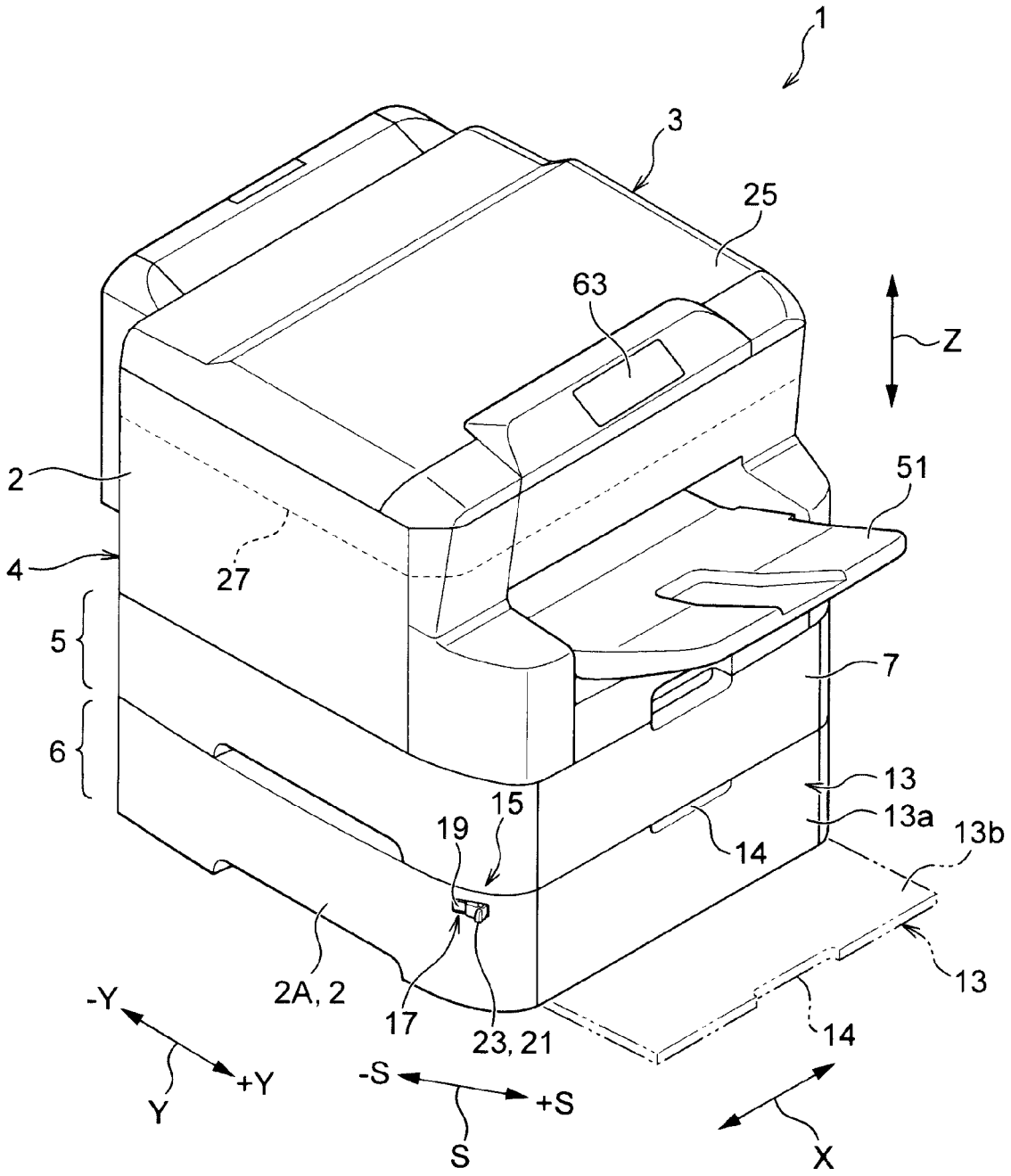
FIG. 1 is an external perspective view illustrating a printing apparatus according to an embodiment of the present disclosure.

First, an embodiment of the present disclosure will be briefly described. A printing apparatus according to a first aspect of the present disclosure for solving the above-described problems includes an insertion slot to which a container containing a print-related component relating to printing performed by a print section is to be detachably attached, an access cover openably and closably covering the insertion slots, and a locking mechanism configured to lock the access cover. The locking mechanism includes a slide member disposed inside an outer casing at a position corresponding to an opening provided in the outer casing of the printing apparatus, the slide member being configured to be moved in a slide direction to switch a state of the access cover between a locked state and an unlocked state, and a restriction portion configured to be moved in the slide direction together with the slide member. In a state in which the slide member is in a lock position on one end side of the opening in the slide direction, the restriction portion protrudes from the opening and the movement in the slide direction is regulated, in a state in which the slide member is in an unlock position on the other end side of the opening in the slide direction, the restriction portion is retracted inside the opening and the movement in the slide direction is permitted, and the restriction portion includes an operation portion configured to move the slide member from the outside of the opening between the lock position and the unlock position.

According to this aspect, in a state in which the slide member is in a lock position on one end side of the opening in the slide direction, the restriction portion protrudes from the opening, and in a state in which the slide member is in an unlock position on the other end side of the opening in the slide direction, the restriction portion is retracted inside the opening. Specifically, a restriction portion that is moved together with the slide member in a slide direction and at a lock position, operated separately from the slide member and protrudes from the opening is provided. With the protrusion structure of the restriction portion, in a state in which the slide member is in a lock position, even if the slide member is moved in an unlock direction, the slide member is not readily moved in the unlock direction. Accordingly, the risk of the locking mechanism of being inadvertently moved from the locked state to the unlocked state can be reduced.

In the printing apparatus according to a second aspect of the present disclosure, in the first aspect, a width of the opening in a direction intersecting the slide direction on the other end side may be narrower than a width of the restriction portion to regulate the restriction portion not to protrude from the opening and regulate the movement in the slide direction of the restriction portion that is in the lock position on the one end side and protrudes from the opening, and a width of the opening in the direction intersecting the slide direction on the one end side may be wider than a width of the restriction portion to permit the restriction portion to protrude from the opening.

According to the aspect, a width of the opening in the direction intersecting the slide direction on the other end side is narrower than a width of the restriction portion. With this structure, when the slide member is in the unlock position, the restriction portion is retracted inside the opening and thus no unnecessary protrusion protrudes from the outer surface of the outer casing of the printing apparatus.

In the printing apparatus according to a third aspect of the present disclosure, in the first aspect or the second aspect, the restriction portion may be configured to be slid with respect to the slide member, and the restriction portion may include a pressing member configured to press the restriction portion in a direction protruding from the opening in a state in which the slide member has been moved to the lock position.

According to the aspect, the restriction portion includes a pressing member configured to press the restriction portion in a direction protruding from the opening. With this structure, when the slide member is moved to the unlock position, the restriction portion automatically protrudes from the opening, and thus the good operability is provided.

In the printing apparatus according to a fourth aspect of the present disclosure, in any one of the first aspect to the third aspect, the operation portion may be a protrusion, and a width of the opening in the direction intersecting the slide direction on the one other end side may be wider than a width of the protrusion, and the protrusion may always protrude from the opening.

According to the aspect, in a state in which the slide member is moved to the unlock position and the restriction portion is moved inside the opening, the protrusion that functions as an operation portion protrudes from the opening. With this structure, the protrusion can be readily operated to change the state of the slide member to the locked state, and the good operability can be provided.

In the printing apparatus according to a fifth aspect of the present disclosure, in any one of the first aspect to the fourth aspect, the restriction portion may have a through hole in the portion protruding from the opening.

According to the aspect, the restriction portion has a through hole in the portion protruding from the opening. With this structure, for example, a lock such as a padlock may be inserted into the through hole and locked to prevent the slide member from being moved. With this lock, the cover member can be maintained in the closed state and the cover member cannot be opened without unlocking the lock such as the padlock and detaching the lock from the through hole.

In the printing apparatus according to a sixth aspect of the present disclosure, in any one of the first aspect to the fifth aspect, a link mechanism configured to be moved in response to a movement of the slide member may be provided. When the slide member is in the lock position, the link mechanism regulates the operation for opening the access cover.

According to the aspect, with a link mechanism configured to be moved in response to a movement of the slide member, the open operation of the access cover is regulated.

With this structure, the slide member only needs the operation portion for operating the link mechanism, and the simple structure can be provided. Furthermore, the link mechanism enables the access cover to be in a locked state, and thus the link mechanism can readily provide the structure in the secure and stable state.

In the printing apparatus according to a seventh aspect of the present disclosure, in the sixth aspect, the link mechanism may include a swing link plate configured to swing about a pivot within a predetermined angle range and has a long working length, an urging member configured to urge the swing link plate in an unlock direction, an engagement receiving portion provided in a portion of the swing link plate and is configured to engage with an engaging claw portion that is provided with respect to the slide member, and an engagement hook provided in a portion of the swing link plate and is configured to enter an engagement groove portion provided in the access cover and engage with an engagement bar that is disposed in the engagement groove portion.

According to the aspect, the link mechanism includes, as a main component, a swing link plate configured to swing about a pivot within a predetermined angle range and has a long working length. With this structure, the rigid link mechanism can be provided, and the position for operating the locking mechanism and the lock position can be located apart. Furthermore, when an external force for opening the access cover is applied, the force acts on the straight line connecting the pivot of the swing link plate and the engagement hook, and the force does not act in a swing direction for swinging the swing link plate in the unlock direction. With this structure, it can be prevented that the external force acts on the slide member having the operation portion of the locking mechanism, causing damage to the slide member or the engagement hook is accidentally disengaged from the engagement bar.

In the printing apparatus according to an eighth aspect of the present disclosure, in any one of the first aspect to the fifth aspect, the slide member may include an engaging portion, and when the slide member is in the lock position, the engaging portion may regulate the operation for opening the access cover.

According to the aspect, when the slide member is in the lock position, the engaging portion regulates the operation for opening the access cover. With this structure, the operation for opening the access cover can be regulated without increasing the number of components.

Embodiment

Figure 2:
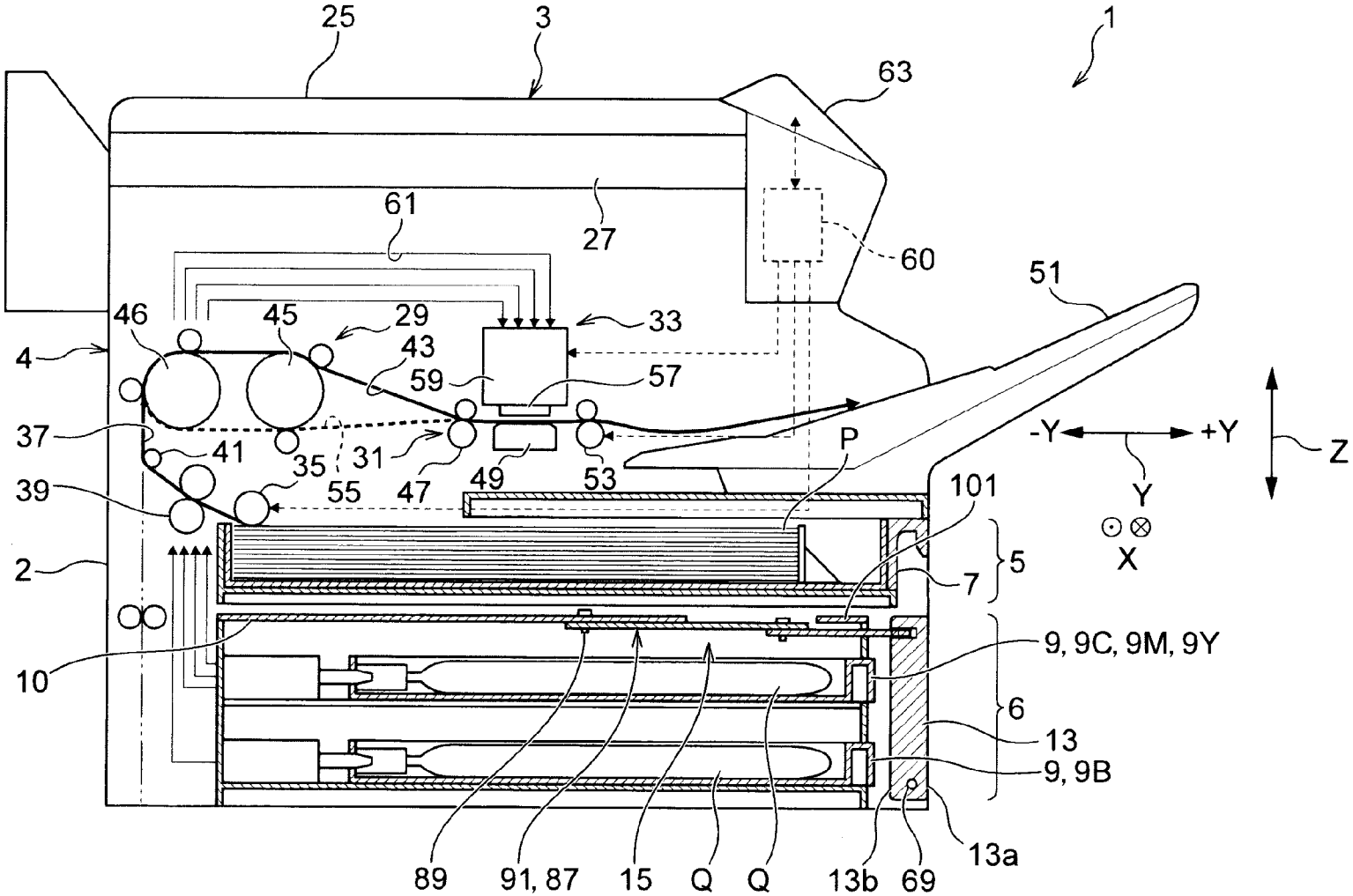
FIG. 2 is a side cross-sectional view illustrating a printing apparatus according to an embodiment of the present disclosure.

Hereinafter, a printing apparatus according to an embodiment of the present disclosure will be described in detail with reference to FIG. 1 to FIG. 23. In the following description, with reference to FIG. 1 and FIG. 2, first, an overall structure of a printing apparatus according to an embodiment of the present disclosure will be described. Then, with reference to FIG. 1 to FIG. 21, characteristic components, which are main components of the printing apparatus, and their peripheral components will be specifically described.

Operations of the printing apparatus according to the embodiment of the present disclosure will be specifically described with the descriptions of a basic operation of the printing apparatus, attachment and detachment operations of a container, lock and unlock operations of a locking mechanism, and an access cover attachment operation. Furthermore, a modification of the structure of an urging member in the printing apparatus according to the embodiment of the present disclosure and the operation of the urging member will be described, and then the operations and effects of the printing apparatus according to the embodiment of the present disclosure will be described. Then, other embodiments of the present disclosure having some structures different from those in the printing apparatus according to the embodiment will be briefly described.

1. Schematic Overall Structure of Printing Apparatus (see FIG. 1 and FIG. 2)

A printing apparatus 1 according to the embodiment of the present disclosure includes an insertion slot 11 (see FIG. 3) to which a container 9 (if a plurality of containers 9 are to be distinguished, the containers 9 are described as 9B, 9C, 9M, 9Y, . . . ) that accommodates a print-related component Q relating to printing to be performed by a print section 33 is detachably attached, an access cover 13 that openably and closably covers a front surface of a liquid cassette mounting section 6 having the insertion slot 11, and a locking mechanism 15 for locking the access cover 13. The locking mechanism 15 is disposed inside an outer casing 2 at a position corresponding to an opening 17 that is provided in the outer casing 2 of the printing apparatus 1. The locking mechanism 15 includes a slide member 19 to be moved in a slide direction S (+S and −S) to switch a state of the access cover 13 between a locked state and an unlocked state, and a restriction portion 21 that moves together with the slide member 19 in the slide direction S.

The restriction portion 21 protrudes from the opening 17 when the slide member 19 is in a lock position S1 (see FIG. 4) on one end side (+S side) of the opening 17 in the slide direction S, and is retracted inside the opening 17 when the slide member 19 is in an unlock position S2 (see FIG. 3) on the other end side (−S side) of the opening 17 in the slide direction S. The restriction portion 21 has an operation portion 23 for moving the slide member 19 from the outside of the opening 17 between the lock position S1 and the unlock position S2.

The printing apparatus 1 in the drawings is a multifunction ink jet printer including, stacked in sequence, a scanner 3, which is an image reading apparatus provided in an upper part, a printer body 4, which is provided under the scanner 3, a medium cassette mounting section 5, which is provided under the printer body 4, and the liquid cassette mounting section 6, which is a lowermost part. On a front side of the liquid cassette mounting section 6, the insertion slot 11 for attaching a liquid cassette 9 is provided. The liquid cassette 9 is a container that accommodates large capacity liquid storage packs Q, which are example print-related components. For example, four liquid storage packs Q for storing inks of four colors of black (B), cyan (C), magenta (M), and yellow (Y) respectively are provided. For the liquid storage packs Q, four liquid cassettes 9B (black), 9C (cyan), 9M (magenta), and 9Y (yellow) corresponding to the inks of the four colors are provided.

The scanner 3 is a so-called flatbed scanner, and includes a cover 25 that can be opened upward or closed downward, a document positioning plate for setting a document in the apparatus, and a body section 27 including an image sensor for reading image information on a document, a drive mechanism for driving the image sensor in a scanning direction, and other components. The printer body 4 includes a feeding section 29 for feeding a medium P set in a medium cassette 7, a transport section 31 for transporting the medium P fed from the feeding section 29, and a print section 33 for performing printing to the medium P transported from the transport section 31.

The feeding section 29 includes a pickup roller 35, a first feeding path 37, a separation roller 39, a guide roller 41, a second feeding path 43, a feeding roller 45, a reversing roller 46, a feed drive motor (not illustrated), and a feed gear train (not illustrated). The pickup roller 35 is disposed in the medium cassette mounting section 5. The first feeding path 37 feeds a medium P picked up by the pickup roller 35 toward the printer body 4 disposed above. The separation roller 39 and the guide roller 41 are disposed on the first feeding path 37. The second feeding path 43 feeds the medium P from an end of the first feeding path 37 toward a transport roller 47, which will be described below. The feeding roller 45 and the reversing roller 46 are disposed on the second feeding path 43. The feed drive motor and the feed gear train apply a driving force to the pickup roller 35, the separation roller 39, the feeding roller 45, and the reversing roller 46.

The transport section 31 includes the transport roller 47, a platen 49, a discharging roller 53, a transport drive motor (not illustrated), and a transport gear train (not illustrated). The transport roller 47 nips the medium P fed by the feeding section 29 and transports the medium P toward the print section 33. The platen 49 supports the medium P to which the transport force has been applied by the transport roller 47. The discharging roller 53 discharges the printed medium P toward a discharge stacker 51. The transport drive motor and the transport gear train apply a driving force to the transport roller 47 and the discharging roller 53. The illustrated embodiment also includes a reversing path 55 that is rotated in a reverse direction with the transport roller 47 and the discharging roller 53, from the discharging roller 53 through the transport roller 47, further through under the feeding roller 45 and the reversing roller 46, and merges at the end of the first feeding path 37.

The print section 33 includes a print head 57, a carriage 59, a carriage drive motor (not illustrated), a timing belt (not illustrated), and a liquid tube 61. The print head 57 discharges an ink, which is an example liquid supplied from the liquid storage pack Q, onto an upper surface, which is a surface to be printed, of a medium P to perform desired printing. The carriage 59 reciprocates in a scanning direction, for example, in an apparatus width direction X, with the print head 57 mounted thereto. The carriage drive motor drives the carriage 59. The liquid tube 61 connects the print head 57 and the liquid storage pack Q.

The illustrated printing apparatus 1 includes the discharge stacker 51 that protrudes, for example, from the front +Y of the outer casing 2 toward the front side +Y. An operation panel 63 is disposed, for example, above the discharge stacker 51. In the printer body 4, a control device 60 that controls various operations in accordance with instructions from the operation panel 63 or a personal computer (PC) is provided.

The illustrated medium cassette mounting section 5 is integrated with the printer body 4 by using the outer casing 2 of the printer body 4 as the outer casing 2 of the medium cassette mounting section 5. An insertion slot (not illustrated) is provided on the front side of the outer casing 2 of the medium cassette mounting section 5, and the medium cassette 7 containing media P placed flat can be detachably attached to the insertion slot from the front side +Y. The pickup roller 35 is disposed at the back of the medium cassette mounting section 5, to which the medium cassette 7 is attached, so that a plurality of media P stacked in the medium cassette 7 can be picked up one by one from the uppermost one and supplied to the first feeding path 37. The medium cassette mounting section 5 is provided with a separate additional medium cassette mounting section 5 (not illustrated) that is provided separately from the printer body 4. The additional medium cassette mounting section 5 is attached, for example, to a lower part of the liquid cassette mounting section 6.

The liquid cassette mounting section 6 is provided under the medium cassette mounting section 5 that is integrated with the printer body 4. The liquid cassette mounting section 6 has, for example, an outer casing 2A that is separated from the outer casing 2 of the printer body 4. On a front side of the outer casing 2A of the liquid cassette mounting section 6, four insertion slots 11B, 11C, 11M, and 11Y are provided in upper and lower parts, and in the upper part, three narrow insertion slots 11C, 11M, and 11Y are disposed at equal intervals, and in the lower part, the wide insertion slot 11B is disposed (see FIG. 10).

Into the four insertion slots 11B, 11C, 11M, and 11Y, the liquid cassettes 9B, 9C, 9M, and 9Y can be detachably attached respectively. When the liquid cassettes 9B, 9C, 9M, and 9Y are inserted into the insertion slots 11B, 11C, 11M, and 11Y and attached, the connection portions of the liquid storage packs Q set in the respective liquid cassettes 9B, 9C, 9M, and 9Y are connected to the liquid tubes 61, and thus the inks of respective colors can be supplied toward the print head 57.

On the front side of the outer casing 2A of the liquid cassette mounting section 6, the access cover 13 is provided. For example, the access cover 13 can be set in a horizontal open position in which the access cover 13 is open on the front +Y side or in a vertical closed position in which the access cover 13 covers the front side of the outer casing 2A, about a rotation shaft 69 (see FIG. 17) attached to lower ends of two arm portions 67 of finger-like main body hinge sections 65 protruding from the left and right of the insertion slot 11B in the lower part toward the front +Y. The opening 17 is provided in an upper part of the left side of the liquid cassette mounting section 6 near the front side of the outer casing 2A. In the opening 17, the slide member 19 is provided. The locking mechanism 15 having the slide member 19 and the restriction portion 21 is provided toward the inside of the liquid cassette mounting section 6.

2. Specific Structure of Main Components and Peripheral Components of Printing Apparatus (See FIG. 1 to FIG. 21)

Figure 5:
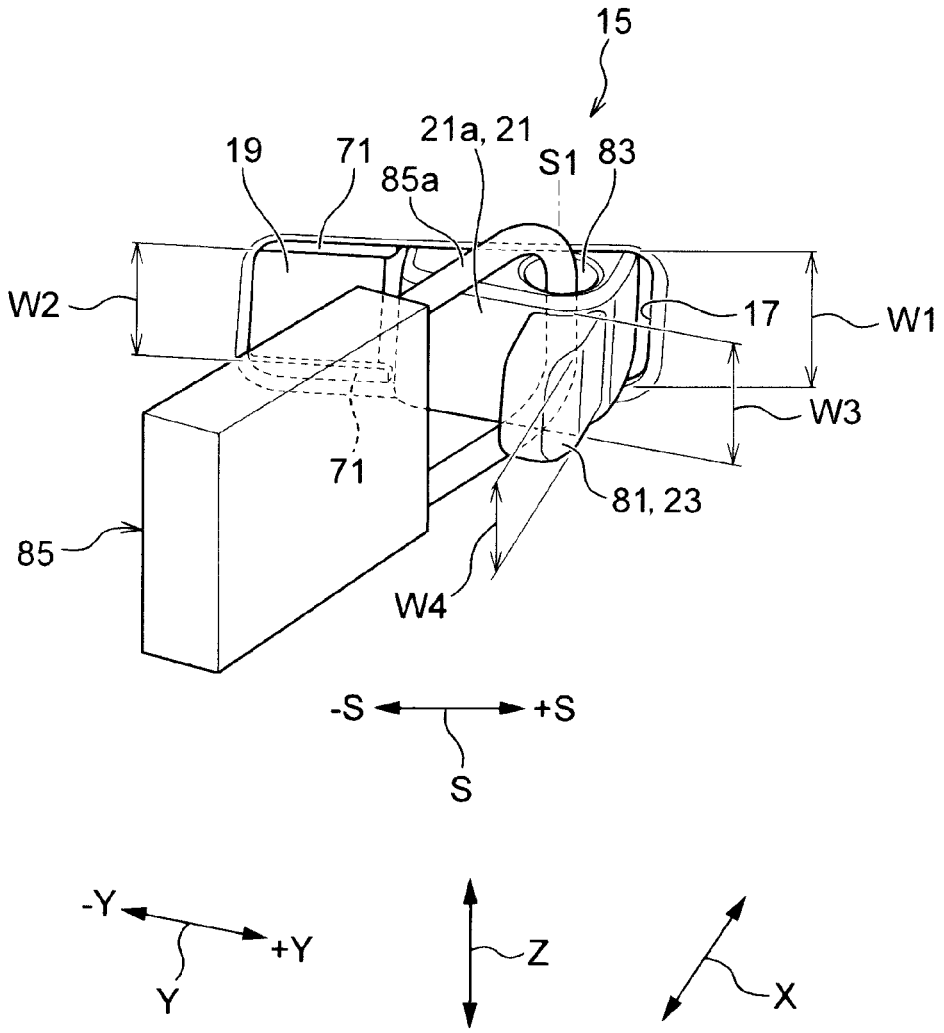
FIG. 5 is a perspective view illustrating the printing apparatus according to the embodiment in which a lock is attached to a restriction portion.

Next, main components and their peripheral components of the printing apparatus 1 according to the embodiment will be specifically described. As illustrated in FIG. 5, the opening 17 has, for example, a long rounded rectangular shape, and has ribs 71 that protrude inward in an upper edge and a lower edge of the opening 17 near the other end in the unlock direction −S, respectively. The width W of the opening 17 in the height direction Z has a wide width W1 near one end in the lock direction +S and a narrow width W2 near the other end in the unlock direction −S, that is, W1>W2.

Figure 13:
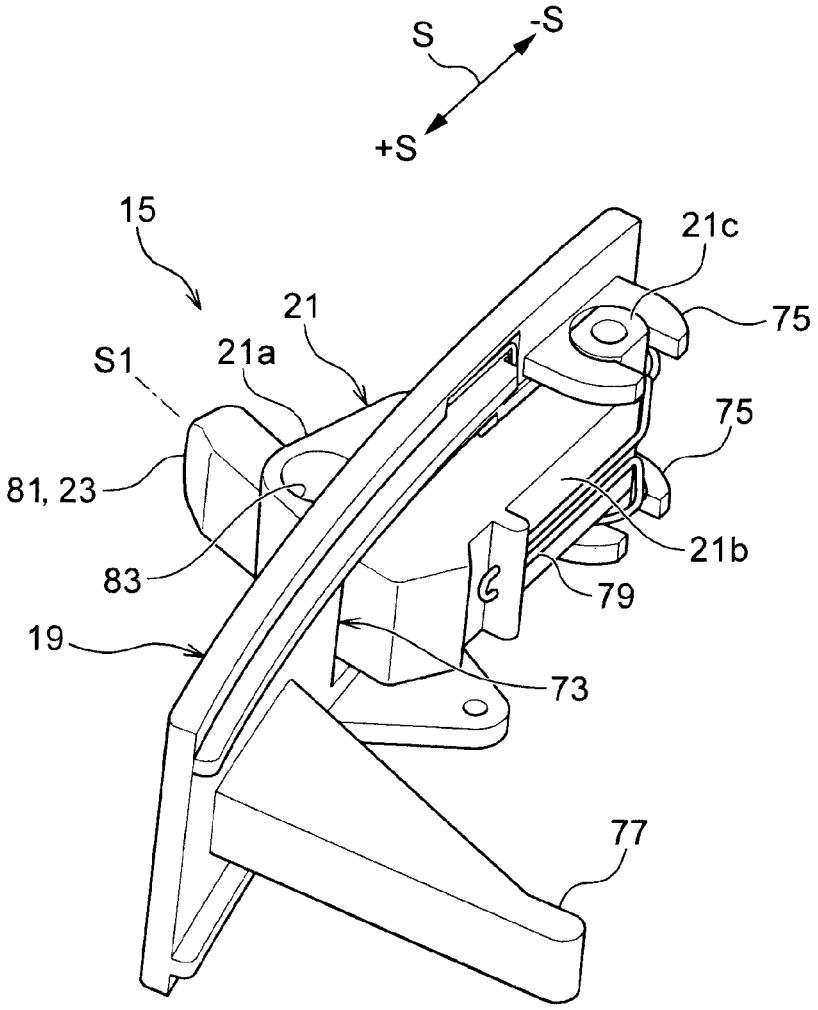
FIG. 13 is a perspective view illustrating a slide member, a restriction portion, and a pressing member in a locked state in the printing apparatus according to the embodiment.
Figure 14:
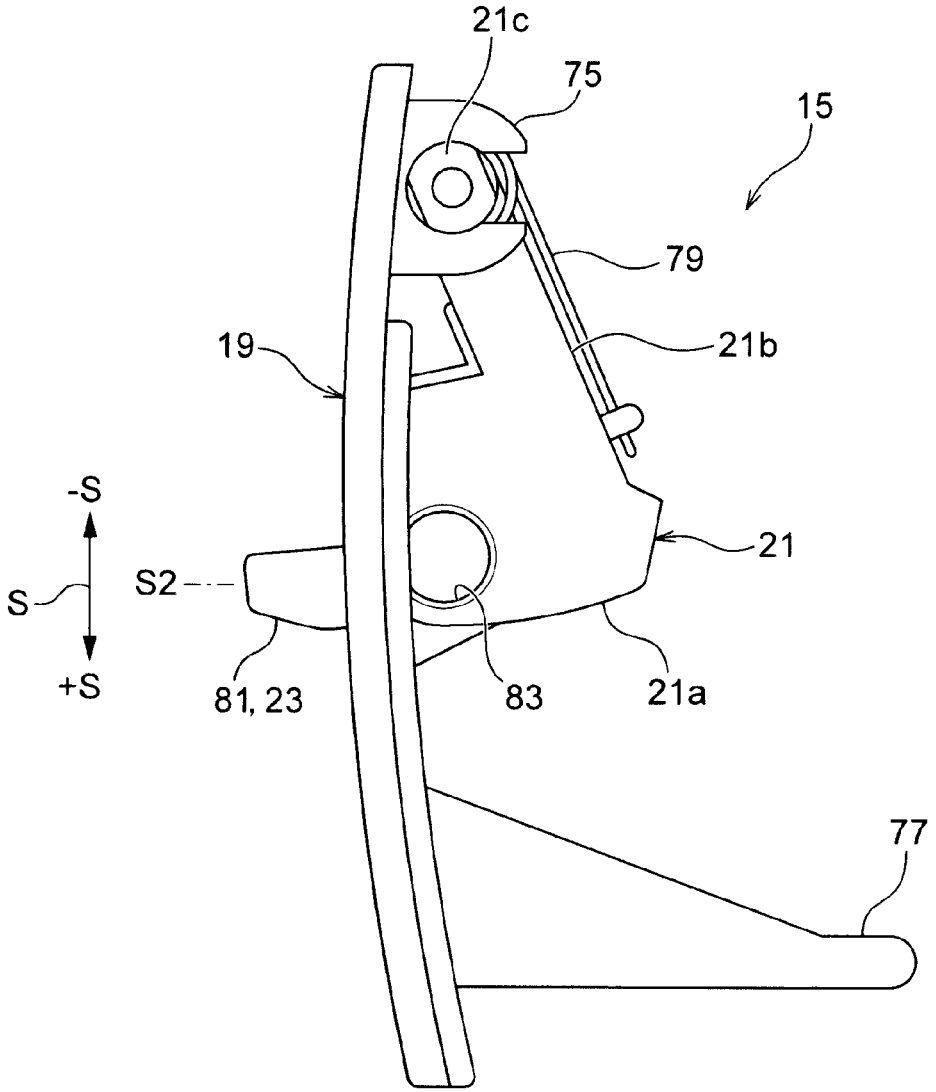
FIG. 14 is a plan view illustrating the slide member, the restriction portion, and the pressing member in an unlocked state in the printing apparatus according to the embodiment.

The slide member 19 is a curved rectangular plate-like member as illustrated in FIG. 13 and FIG. 14. The slide member 19 has a rectangular window-like opening 73 that receives a head portion 21*a* of the restriction portion 21 that is combined with the slide member 19 and is moved together in the slide direction S in a protrudable manner. Bearings 75 are disposed at upper and lower portions of the slide member 19 on the back side near the end portion on the other end side in the unlock direction −S, and a hook-shaped engaging claw portion 77 protruding inward is disposed at a portion of the slide member 19 on the back side near the end portion on one end side in the cock direction +S.

The restriction portion 21 includes a pivot shaft 21*c* that is fitted into the bearings 75 of the slide member 19, an arm portion 21*b* that extends from the pivot shaft 21*c* toward the opening 73 of the slide member 19, and the head portion 21*a* that protrudes from an end of the arm portion 21*b* toward the opening 73 side of the slide member 19. As illustrated in FIG. 5, in this embodiment, the width W2 on the end side in the unlock direction −S that is the other end of the opening 17 in the outer casing 2A is narrower than a width W3 of the head portion 21*a* of the restriction portion 21 in the height direction Z, that is, W1>W3>W2.

Figure 3:
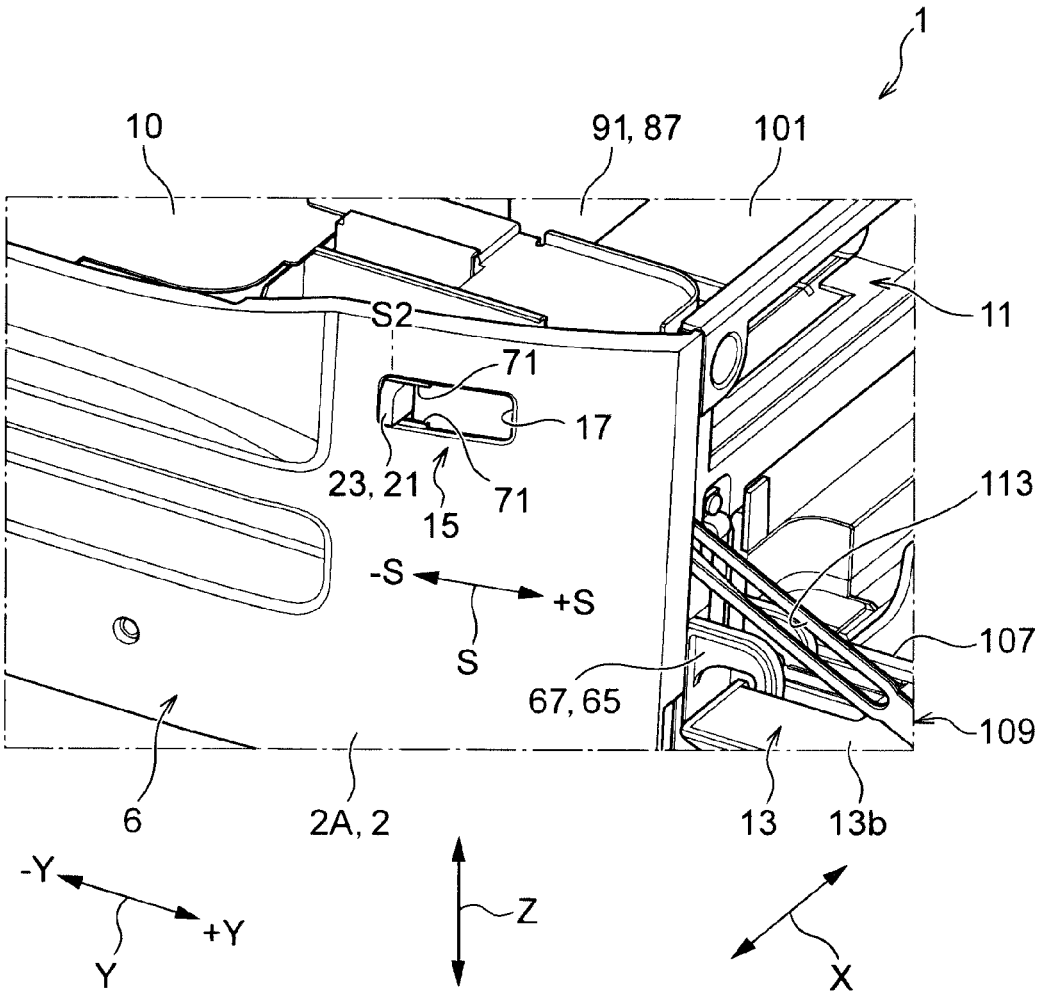
FIG. 3 is an external perspective view illustrating the printing apparatus according to the embodiment in which a locking mechanism is in an unlocked state.
Figure 4:
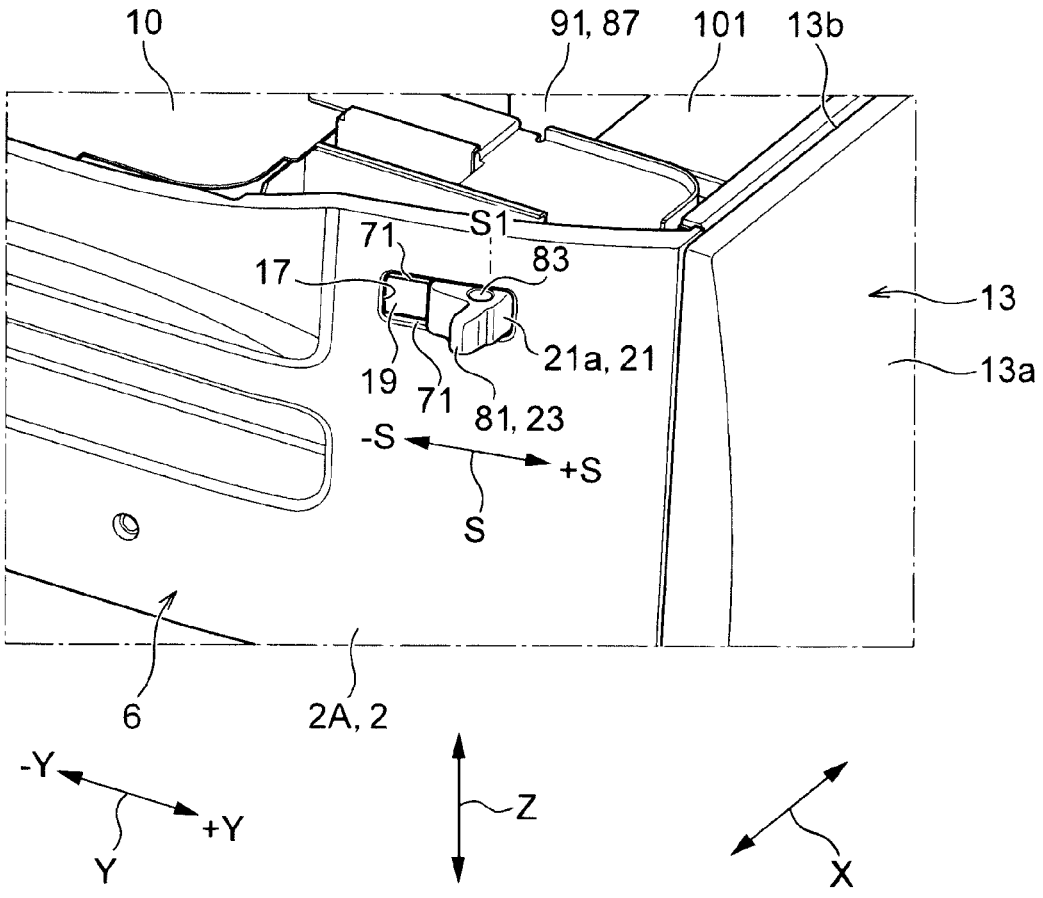
FIG. 4 is an external perspective view illustrating the printing apparatus according to the embodiment in which the locking mechanism is in a locked state.

With this structure, in a state in which the slide member 19 is in the lock position S1, as illustrated in FIG. 13, the head portion 21*a* of the restriction portion 21 protrudes outward from the opening 17 and becomes a state illustrated in FIG. 4 and FIG. 5. The head portion 21*a* comes into contact with the ribs 71 to regulate the movement of the slide member 19 in the unlock direction −S. On the other hand, when the slide member 19 is in the unlock position S2, the ribs 71 regulate the outward movement of the head portion 21*a* of the restriction portion 21. Accordingly, the head portion 21*a* of the restriction portion 21 comes into contact with the inner surfaces of the ribs 71 and located inside the slide member 19 and the outer casing 2A as illustrated in FIG. 3 and FIG. 14.

As illustrated in FIG. 13, the restriction portion 21 can swing about the pivot shaft 21*c* with respect to the slide member 19. As an example pressing member for pressing the head portion 21*a* of the restriction portion 21 in a direction in which the head portion 21*a* protrudes from the opening 17 of the outer casing 2A in a state in which the slide member 19 is moved to the lock position S1, an urging spring 79 that is formed by bending a metal wire in a U shape and winding both ends of the urging spring 79 around the pivot shaft 21*c* is attached to the back side of the arm portion 21*b* of the restriction portion 21.

In the head portion 21*a* of the restriction portion 21, a protrusion 81 that functions as an operation portion to be used to move the slide member 19 in the slide direction S is provided. The protrusion 81 is a plate-like member having a thickness suitable for a user to hold with fingers, and has a shape in which the width W2 of the opening 17 in the unlock direction −S on the end side where the ribs 71 are provided is wider than the width W4 of the protrusion 81 in the height direction Z. Accordingly, W1>W3>W2>W4. The shape of the protrusion 81 is not limited to the protruding shape, but may be various shapes such as a concave shape, a ring shape, or a hook shape for users to place a finger or hand.

The restriction portion 21 has a through hole 83 that is open along the height direction Z with respect to the head portion 21*a* protruding from the opening 17. Into the through hole 83, for example, a bar 85*a* of a lock 85 such as a padlock may be inserted to lock as illustrated in FIG. 5 to prevent an outsider from freely operating the slide member 19 to open or close the access cover 13.

Figure 6:
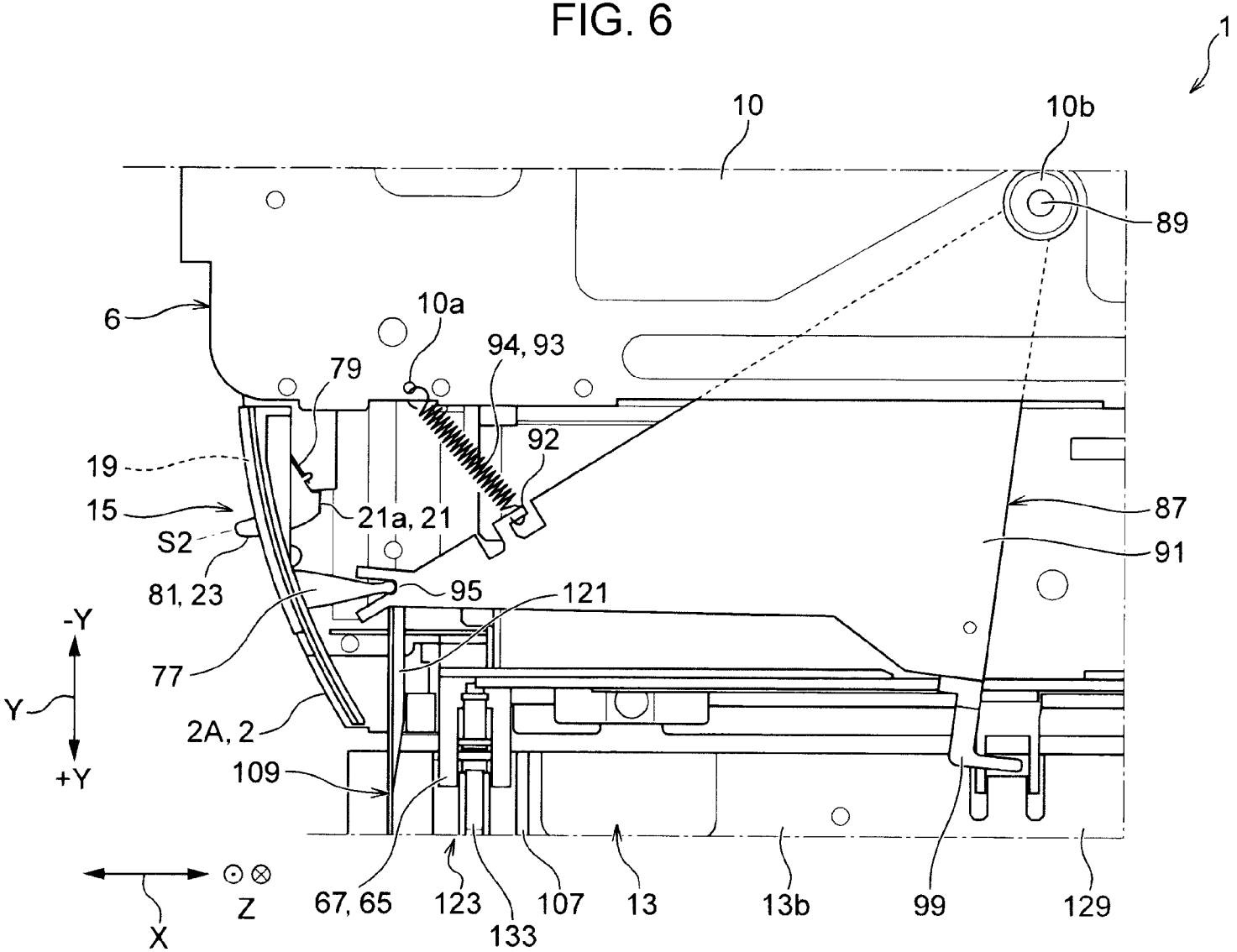
FIG. 6 is a plan view illustrating the printing apparatus according to the embodiment in which a link mechanism is in an unlocked state.

As illustrated in FIG. 6, in an upper space of the accommodating section of the liquid cassette 9 in the liquid cassette mounting section 6, a link mechanism 87 that changes positions with the movement of the slide member 19 is provided. When the slide member 19 is in the lock position S1, the link mechanism 87 regulates the operation for opening the access cover 13.

The link mechanism 87 includes a swing link plate 91, an extension spring 94, a V-shaped engagement receiving portion 95, and a curved L-shaped engagement hook 99. The swing link plate 91 swings about a pivot 89 within a predetermined angle range and has a long working length L. The extension spring 94 is an example urging member 93 that urges the swing link plate 91 in the unlock direction −S. The V-shaped engagement receiving portion 95 is an example engagement receiving portion that is provided in a portion of the swing link plate 91 and engages with the engaging claw portion 77 that is provided with respect to the slide member 19. The engagement hook 99 is provided in a portion of the swing link plate 91 and engages with an engagement bar 98 that is disposed in a groove width direction intersecting a longitudinal direction of an engagement groove portion 97 (see FIG. 8) that is provided in a back side 13*b* of the access cover 13.

The swing link plate 91 is a substantially right-angled triangular plate-like member having a right angle portion in which the engagement hook 99 is provided. In a remaining corner, the pivot 89 is provided, and in another remaining corner, the engagement receiving portion 95 is provided. A spring locking portion 92 for hooking a hook at one end of the extension spring 94 is provided in a middle of the side between the two corner portions where the pivot 89 and the engagement receiving portion 95 are provided respectively. A locking hole 10*a* for hooking a hook at the other end of the extension spring 94 is provided in a top plate 10 of the liquid cassette mounting section 6.

Figure 8:
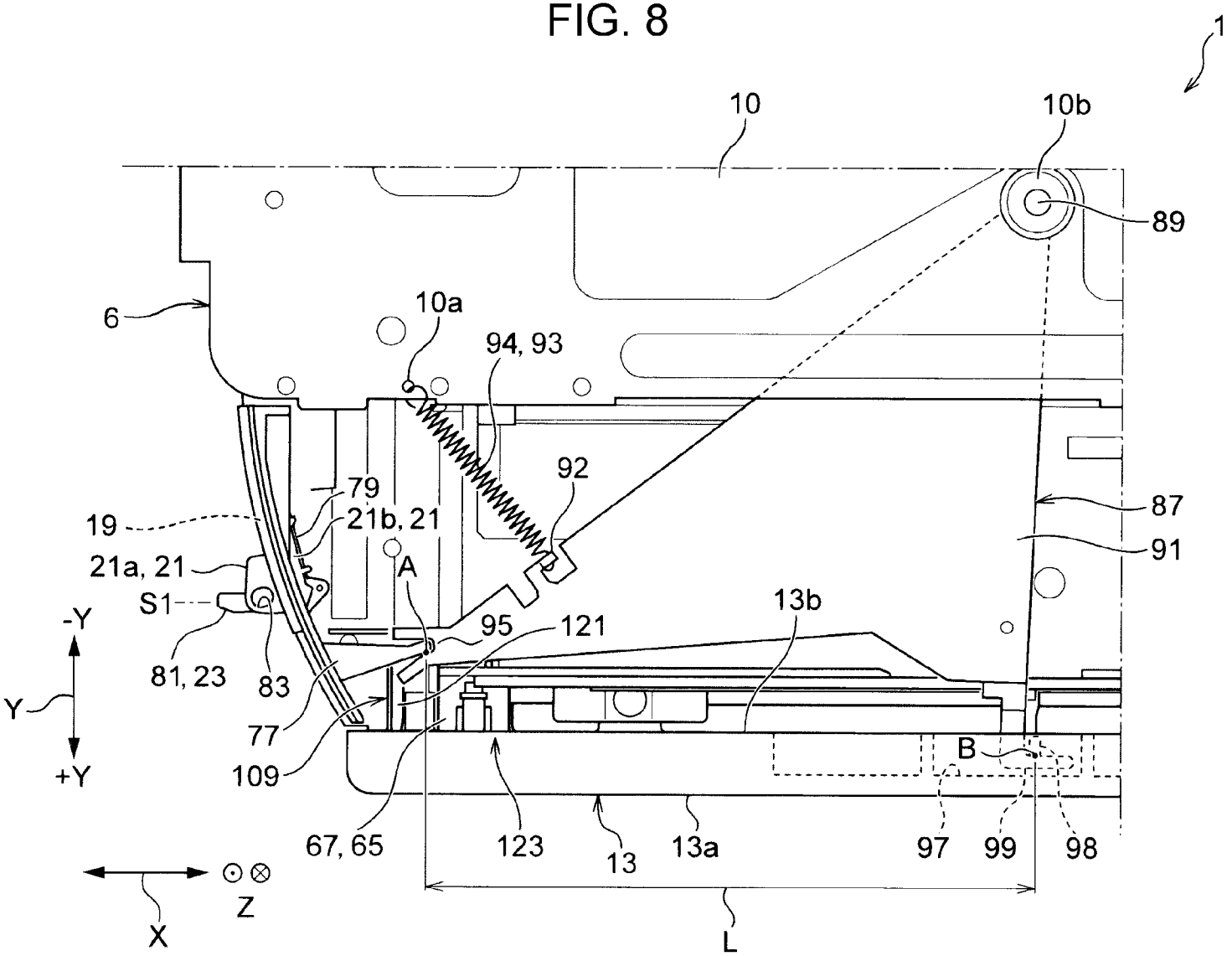
FIG. 8 is a plan view illustrating the printing apparatus according to the embodiment in which the link mechanism is in a locked state.

The position of the front end having the locking hole 10*a* of the top plate 10 is on the back −Y side relative to the position of the spring locking portion 92, and thus the urging force of the extension spring 94 acts in the unlock direction −S to urge the swing link plate 91 in the clockwise direction in FIG. 6 and FIG. 8. The pivot 89 of the swing link plate 91 is pivotally supported by a bearing 10*b* that is provided slightly away from the front end of the top plate 10 toward the back side.

As illustrated in FIG. 8, in this specification, the working length L of the swing link plate 91 is defined as a length in the width direction X connecting a contact point A at which the engagement receiving portion 95 provided in the swing link plate 91 comes into contact with the engaging claw portion 77 of the slide member 19 and a contact point B at which the engagement hook 99 in the swing link plate 91 comes into contact with the engagement bar 98 in the engagement groove portion 97 of the access cover 13. The working length L of the swing link plate 91 is set, for example, to a length slightly shorter than about half of the length of the access cover 13 in the width direction X. With this structure, the operation portion 81, with which the locking mechanism 15 can be operated, can be provided on the side of the outer casing 2A such that the operation portion does not interfere with the opening and closing operations of the access cover 13, and the engagement position of the engagement hook 99 and the engagement bar 98, which is the lock position of the locking mechanism 15, can be set to the center of gravity at a central position of the access cover 13 in the width direction X, enabling the access cover 13 to be held in a strongest force without a tilt.

Figure 10:
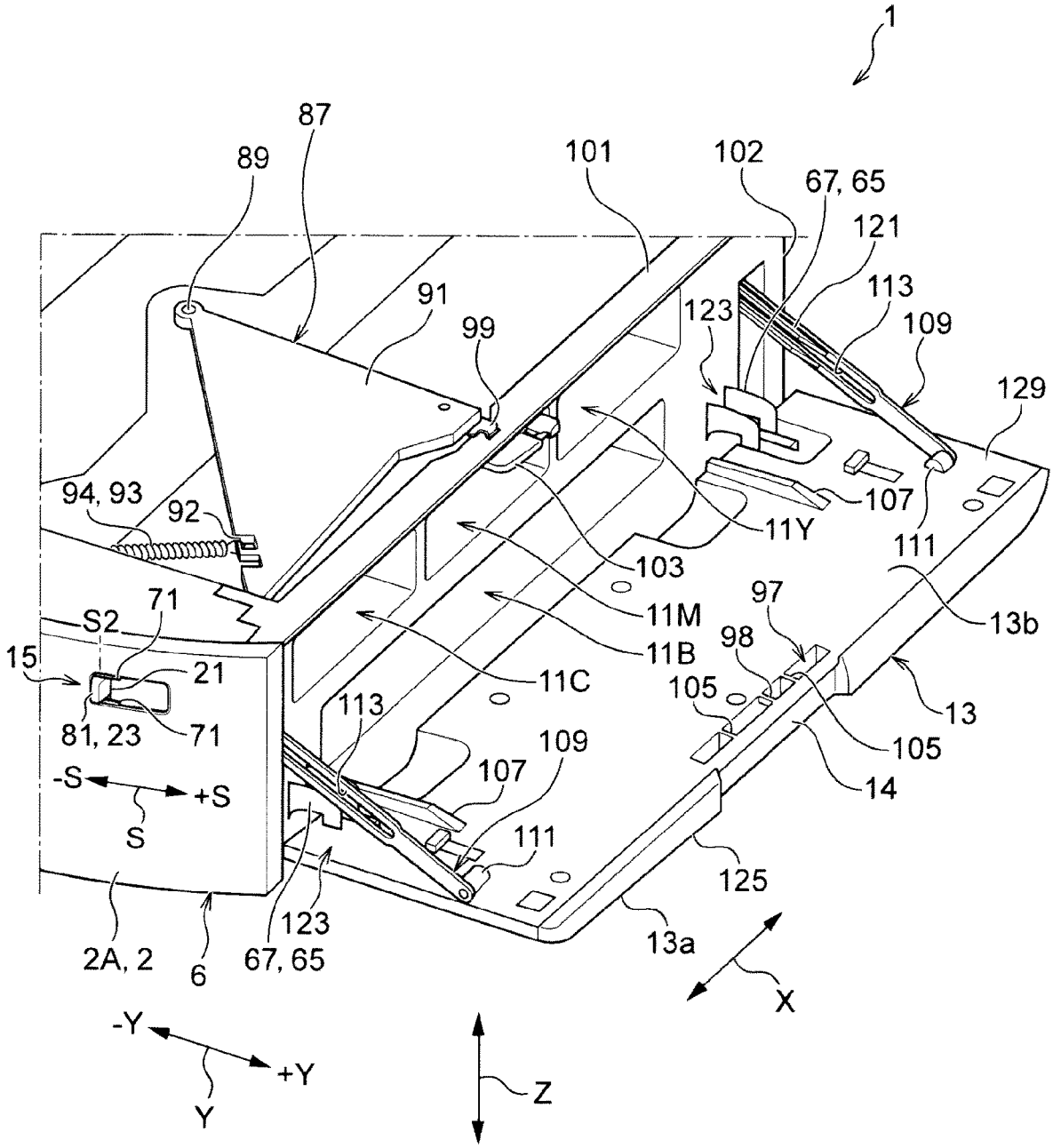
FIG. 10 is a perspective view illustrating the printing apparatus according to the embodiment in which an access cover is open.
Figure 11:
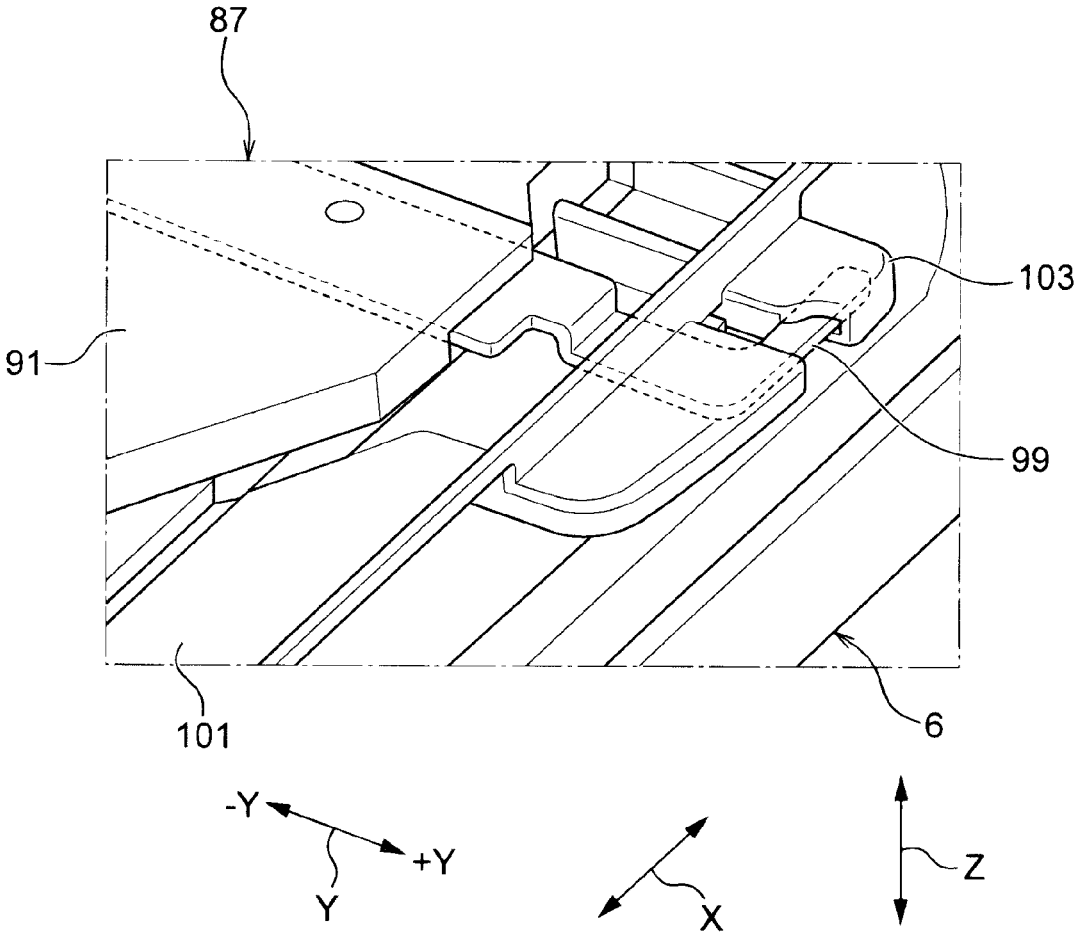
FIG. 11 is an enlarged perspective view illustrating the engagement hook in the printing apparatus according to the embodiment.
Figure 12:
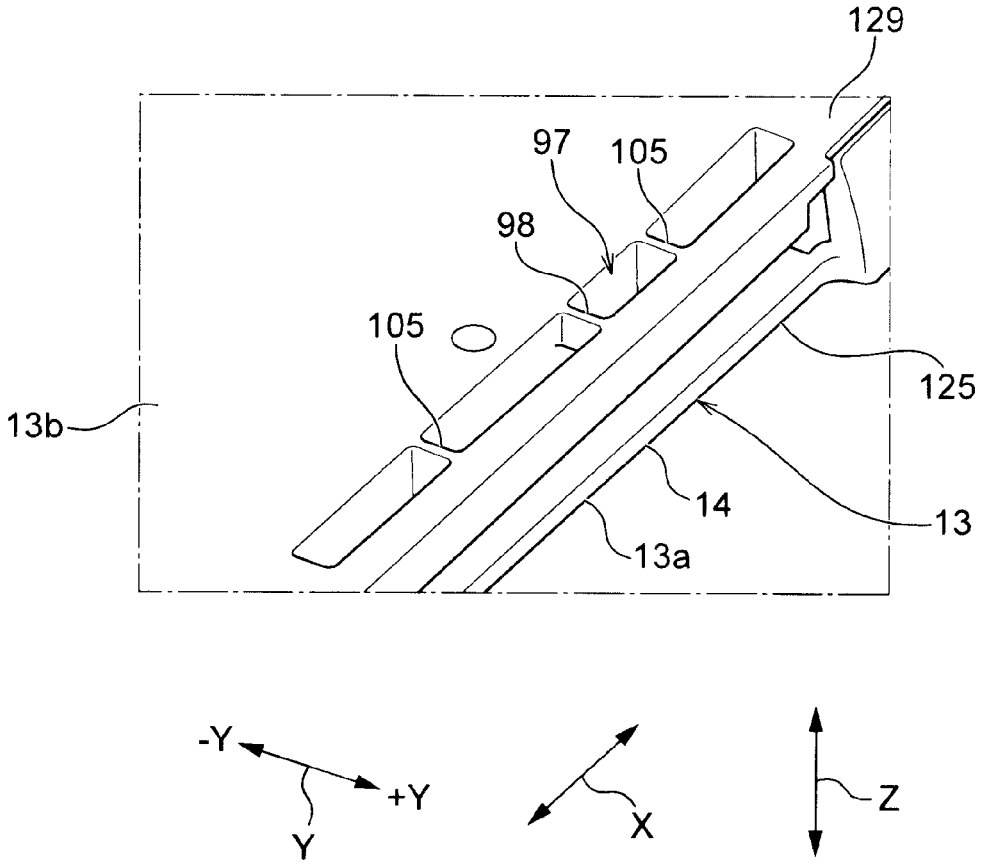
FIG. 12 is an enlarged perspective view illustrating an engagement groove and other components in an access cover in the printing apparatus according to the embodiment.

Furthermore, a reinforcement frame 101 is provided across the left and right side frames 102 to the upper surface of the liquid cassette mounting section 6 on the side closest to the front side as illustrated in FIG. 10, and a hook cover 103 covering the upper surface of the engaging portion at the end of the engagement hook 99 is provided at a central part of the reinforcement frame 101 as illustrated in an enlarged view in FIG. 11. At a central portion of the access cover 13 on the back side on a rotation free end side, as illustrated in FIG. 10, the rectangular engagement groove portion 97 that is long in the width direction X is provided. The engagement groove portion 97 has two reinforcement ribs 105 slightly away from the left and right ends toward the inside, and has the engagement bar 98 at a predetermined position between the reinforcement ribs 105 as illustrated in FIG. 12.

Figure 15:
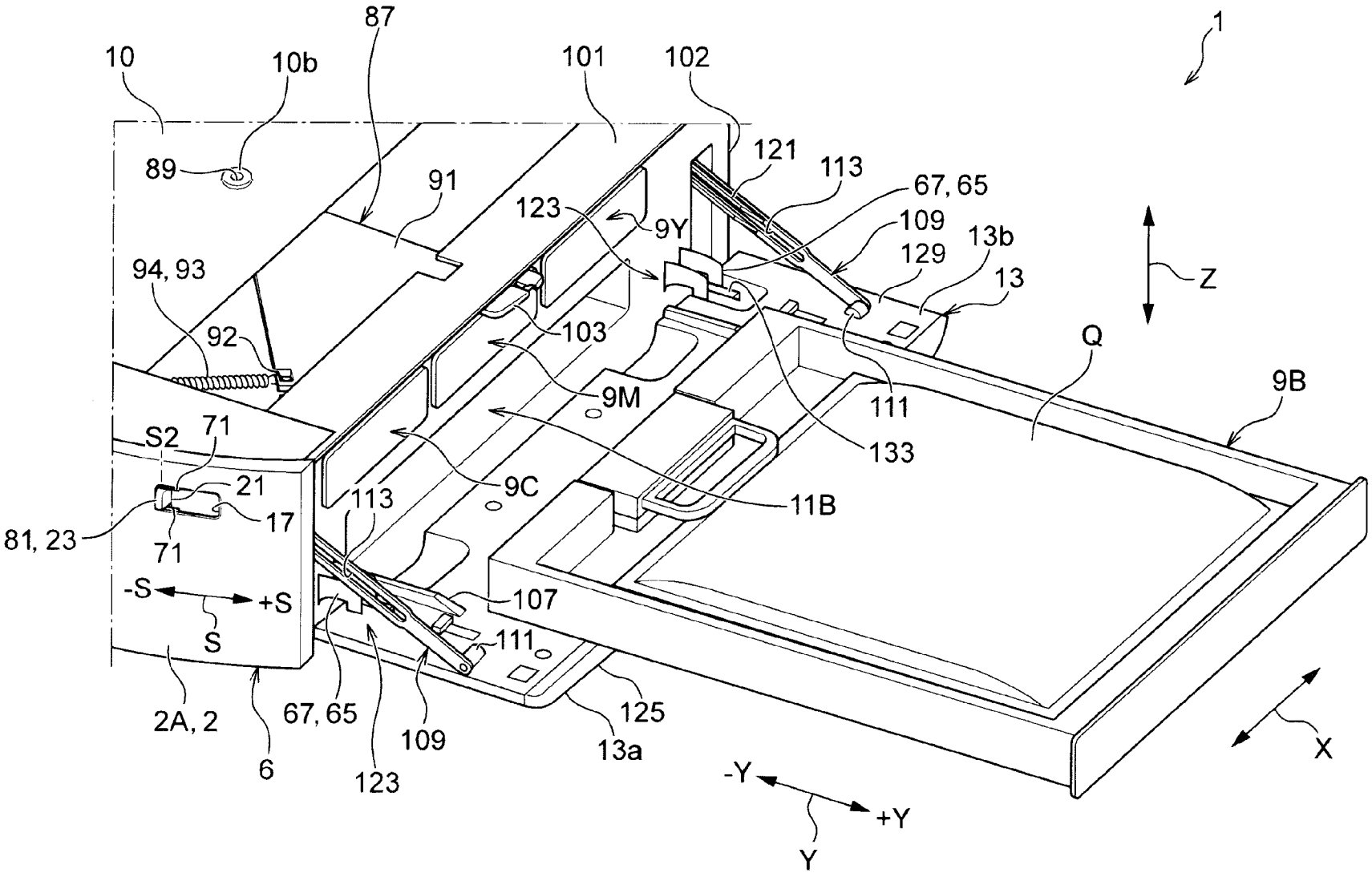
FIG. 15 is a perspective view illustrating the printing apparatus according to the embodiment before a container is inserted into an insertion slot.
Figure 16:
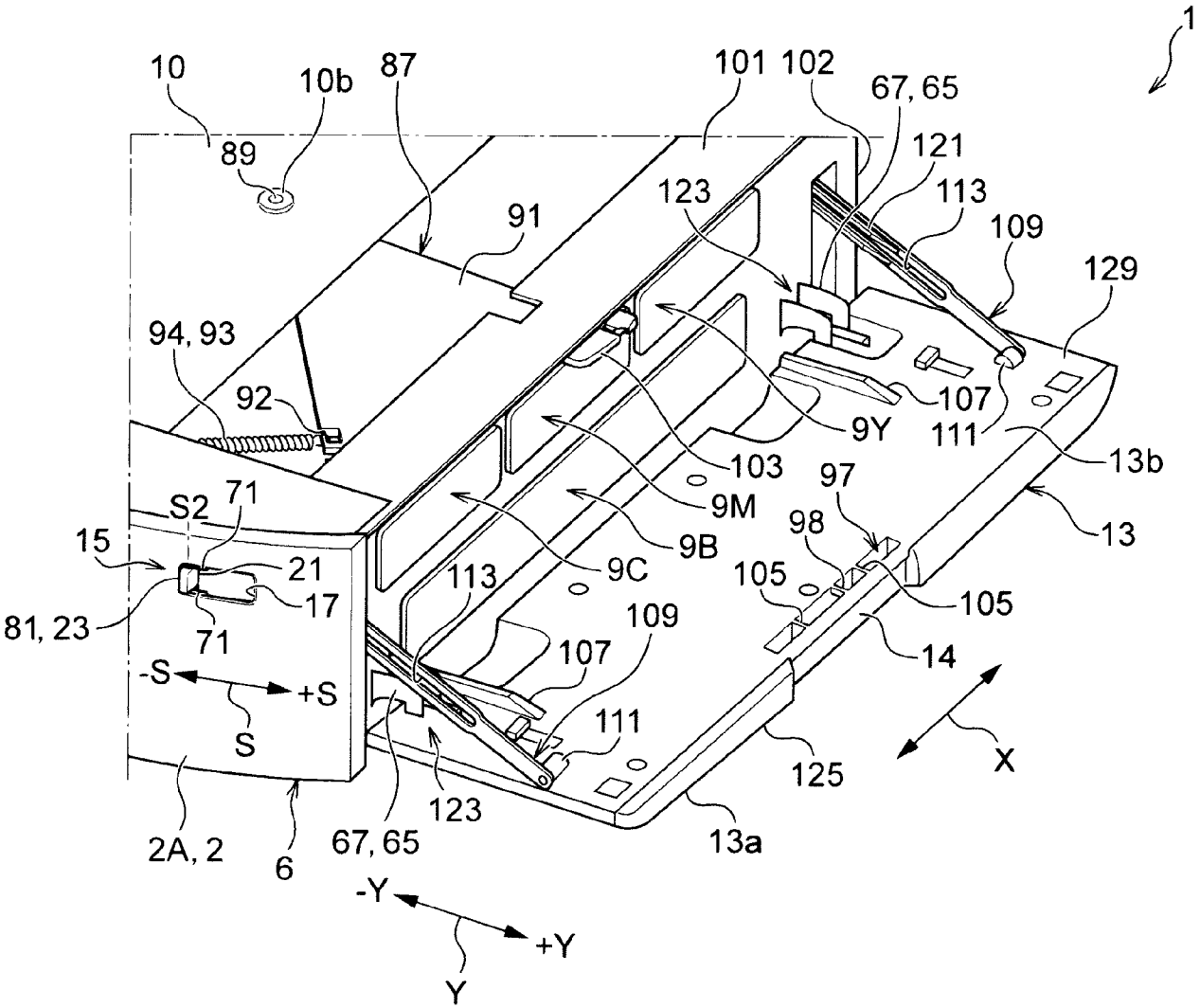
FIG. 16 is a perspective view illustrating the printing apparatus according to the embodiment after the container is inserted into the insertion slot.

As illustrated in FIG. 10, FIG. 15, and FIG. 16, the back side 13*b* of the access cover 13 functions as a guide surface in the height direction Z when the liquid cassette 9B is inserted into the insertion slot 11B. The liquid cassette 9B can be placed on the back side 13*b* in a state in which the access cover 13 is open and can be slid toward the insertion slot 11B to be inserted. Two guide ribs 107 for positioning the liquid cassette 9B in the width direction X in inserting the liquid cassette 9B into the insertion slot 11B are disposed on the left and right sides of the back side 13*b* of the access cover 13 near the rotation base end.

Figure 17:
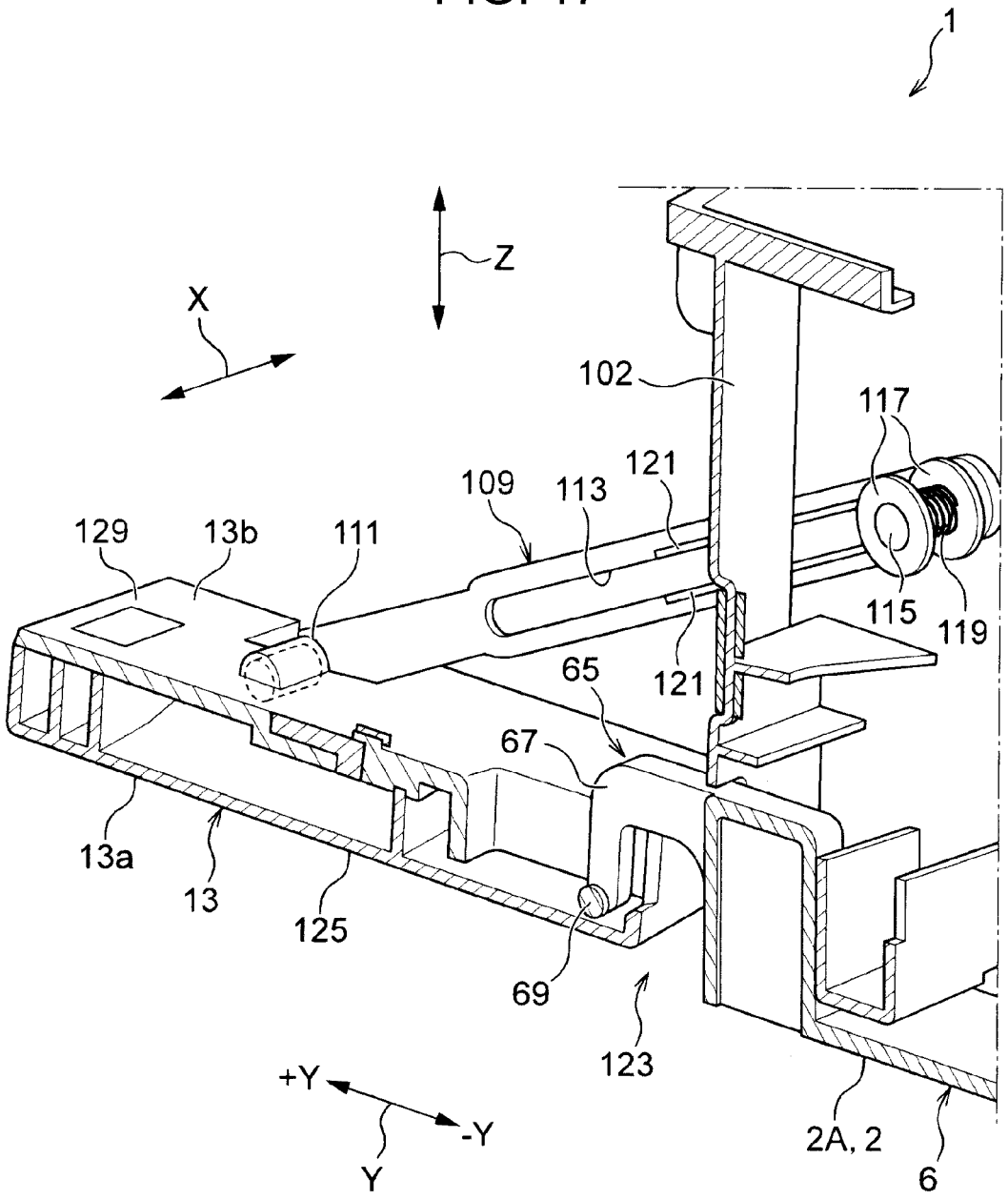
FIG. 17 is a partial cutaway perspective view illustrating a link arm mechanism that supports the access cover in the printing apparatus according to the embodiment.
Figure 18:
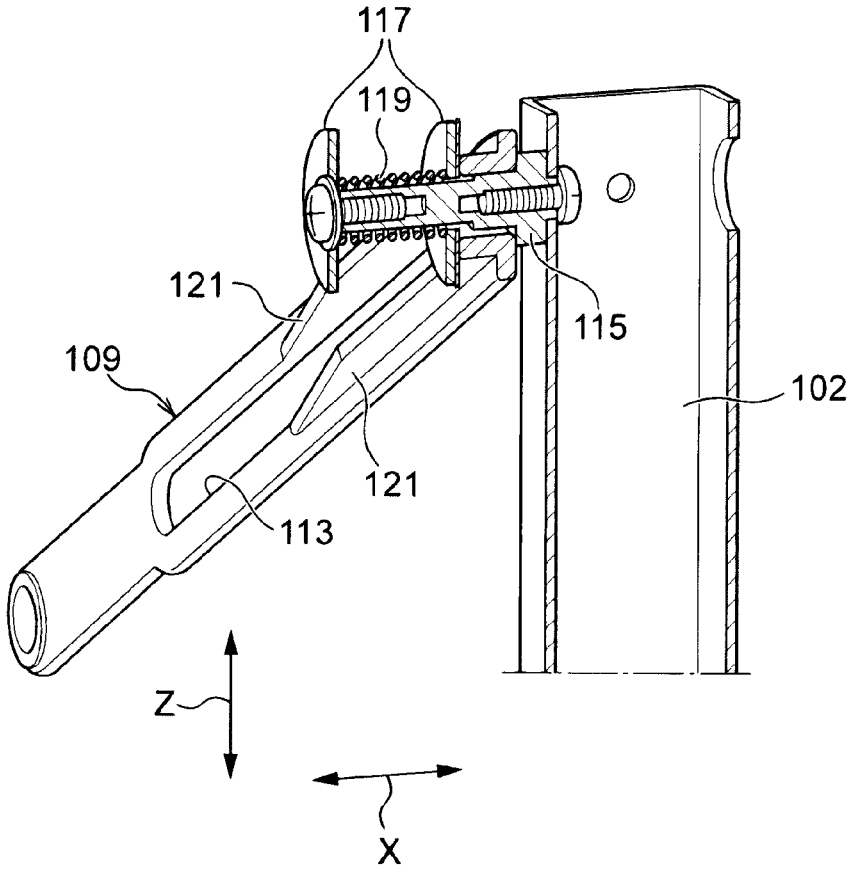
FIG. 18 is an enlarged partial cutaway perspective view illustrating a link arm and a slide supporting point in the printing apparatus according to the embodiment.

The access cover 13 and the side frames 102 on the left and right sides of the liquid cassette mounting section 6 are connected by link arms 109 as illustrated in FIG. 10, FIG. 15, and FIG. 16. The link arm 109 is a plate-like member long in its arm length direction and short in its arm width direction, and at an end portion connected to the access cover 13, a rotation shaft (not illustrated) is attached. The rotation shaft is rotatably connected by bearing portions 111 on the back side 13*b* of the access cover 13. The link arm 109 has a long engagement hole 113 extending in the arm length direction from a base end portion of the link arm 109 to about two-third of the arm length. The engagement hole 113 engages with a slide supporting point shaft 115 attached to the side frame 102 as illustrated in FIG. 17 and FIG. 18, and the engagement position changes within the length of the engagement hole 113 with the rotation of the access cover 13.

To the slide supporting point shaft 115, two washers 117 that function as spring washers are attached. A compression coil spring 119 is compressed between the two washers 117. Two braking ribs 121 extending along the engagement hole 113 are vertically provided on the outer sides of the link arm 109 in the arm width direction across the engagement hole 113. The braking rib 121 is formed such that its height gradually increases from around a middle portion of the engagement hole 113 and from a point the height becomes a predetermined height, the height is kept toward the base end portion of the link arm 109.

The inner washer 117 that is urged inward by the compression coil spring 119 comes into contact with the braking ribs 121, and thereby a braking force corresponding to the height of the braking ribs 121 can be obtained. With the braking ribs 121 of the above-described shape employed in this embodiment, the access cover 13 is smoothly opened with a little braking force in an initial state in which the access cover 13 is opened from the closed position, the braking force is gradually increased as the access cover 13 is further opened, and the braking force becomes maximum just before the access cover 13 becomes horizontal and is opened slowly with substantially no impact noise.

Figure 19:
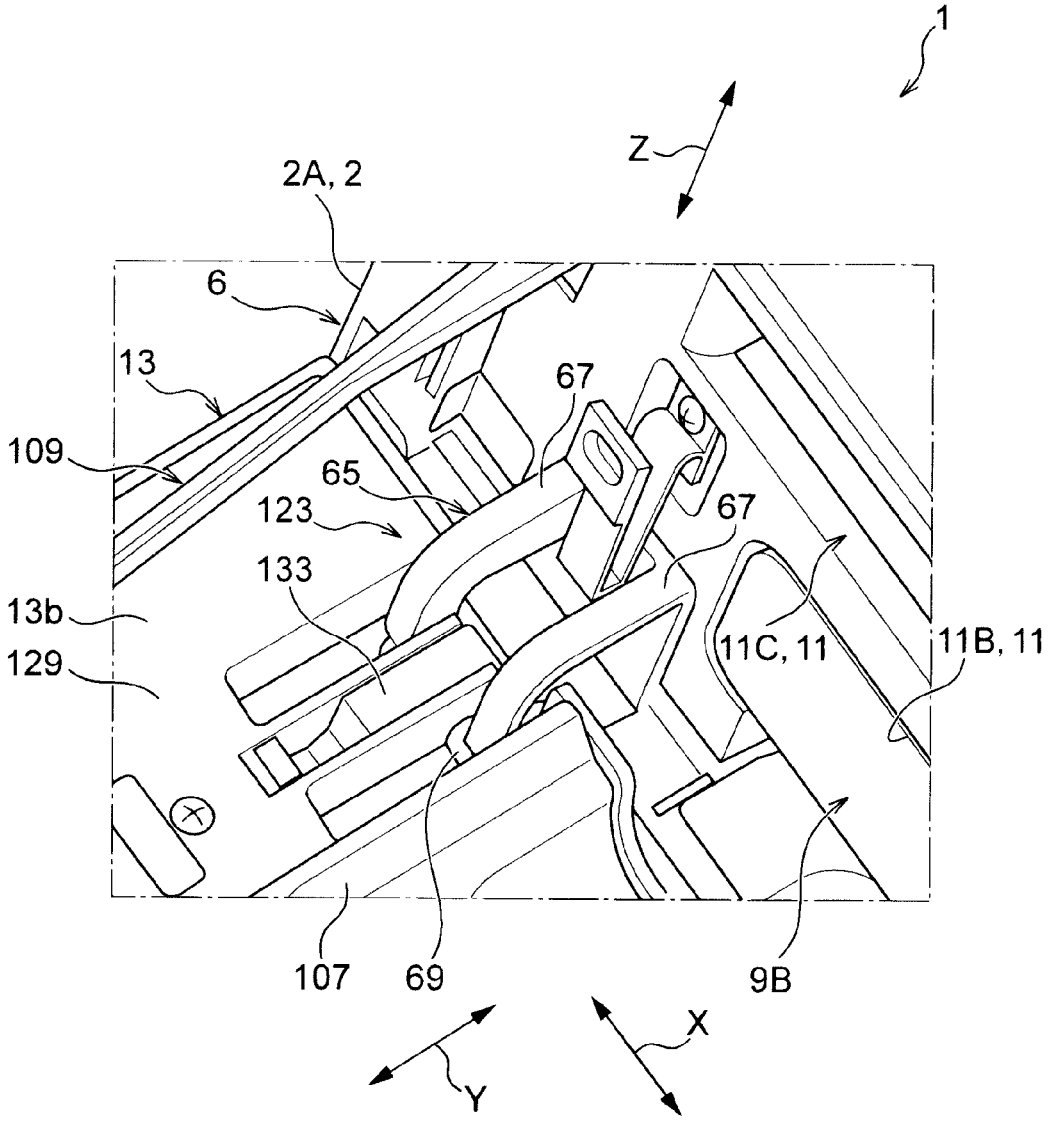
FIG. 19 is an enlarged perspective view illustrating a hinge section of the access cover in the printing apparatus according to the embodiment.
Figure 20:
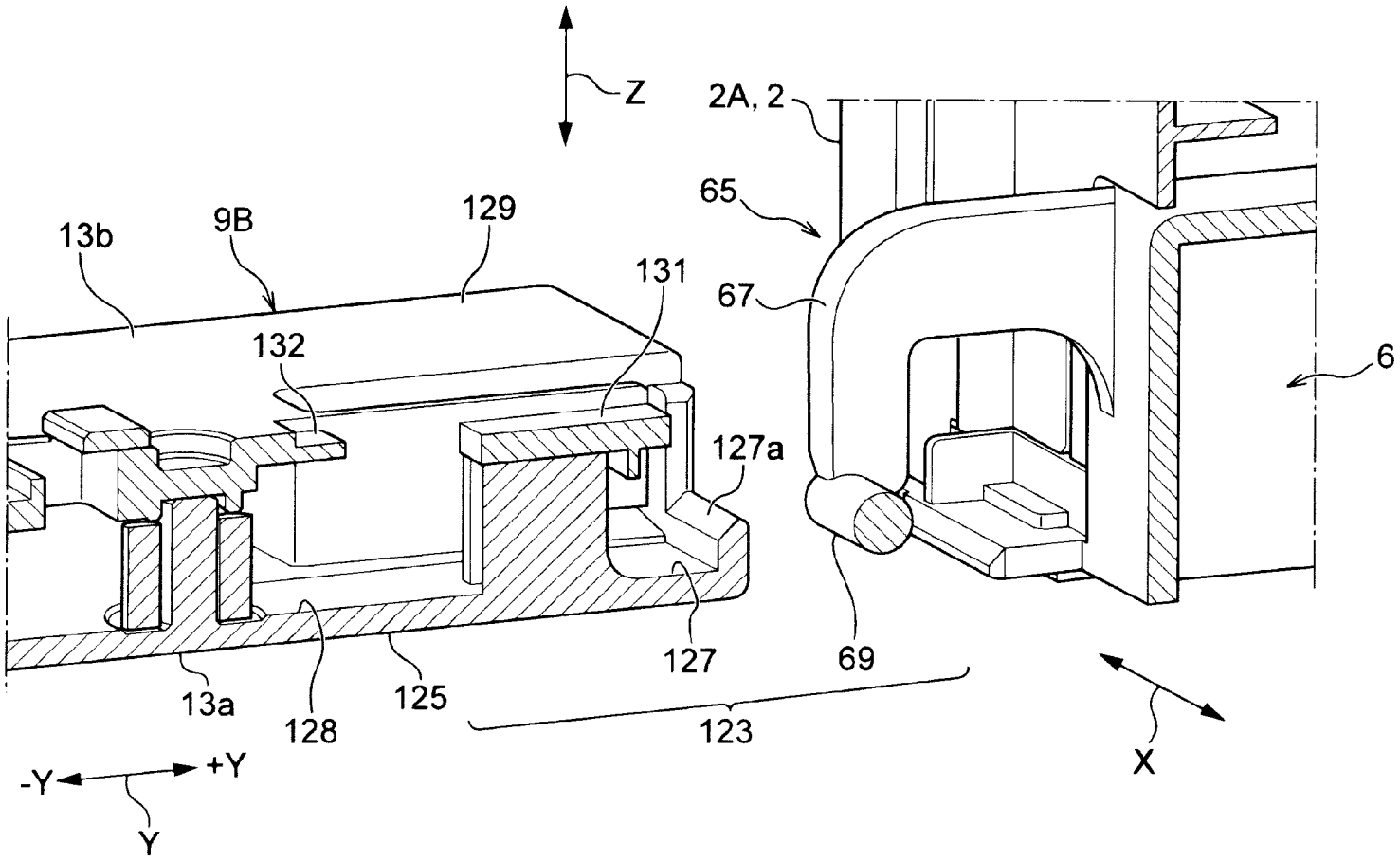
FIG. 20 is a partial cutaway perspective view illustrating the printing apparatus according to the embodiment before the access cover is attached to the apparatus main body.
Figure 21:
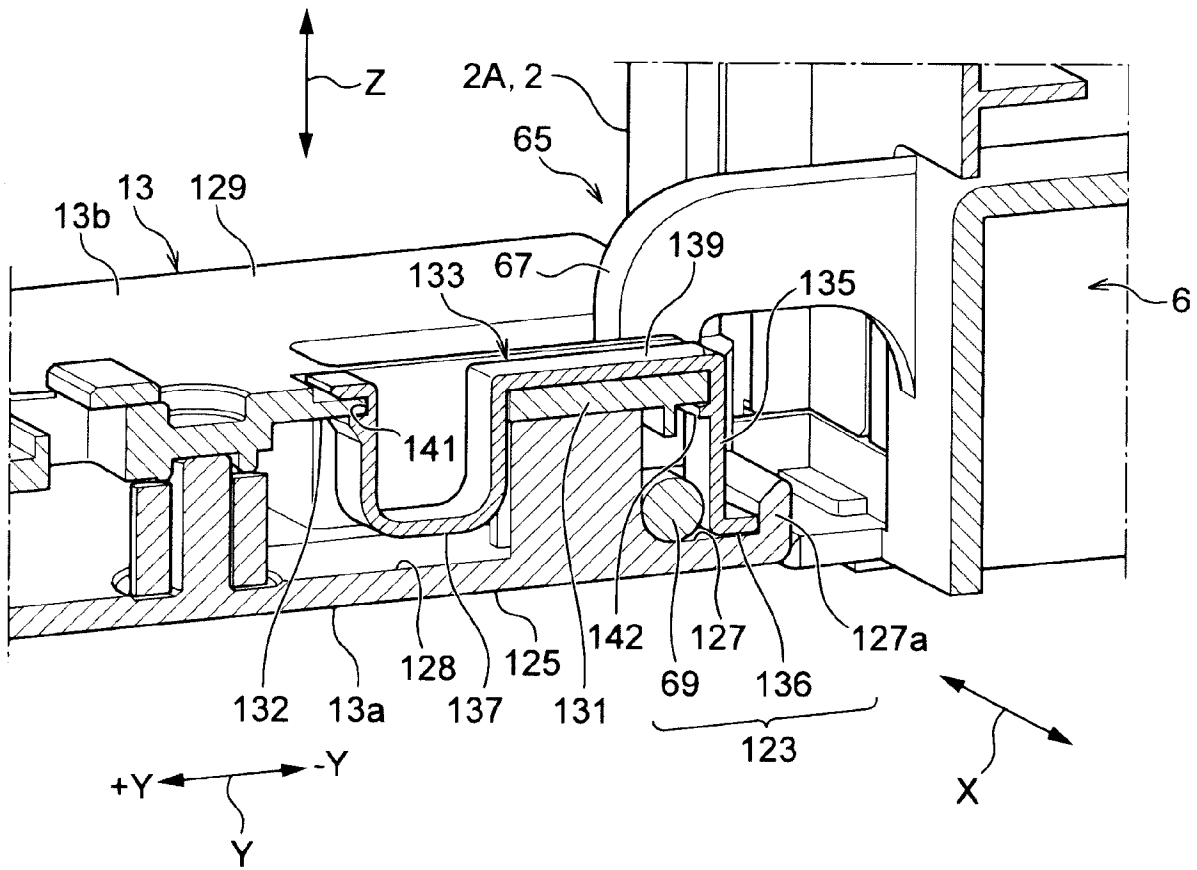
FIG. 21 is a partial cutaway perspective view illustrating the printing apparatus according to the embodiment after the access cover is attached to the apparatus main body.

The rotation shaft 69 of the main body hinge section 65 is rotatably supported by a bearing structure 123 provided in a base end portion of the access cover 13 as illustrated in FIG. 19 to FIG. 21. The bearing structure 123 includes two recessed portions 127 and 128 in a front panel 125 in the front surface 13*a* of the access cover 13, two cover portions 131 and 132 in a rear panel 129 on the back side of the access cover 13, and a curved flat spring-like hinge pressing member 133 attached after combining the recessed portions 127 and 128 and the cover portions 131 and 132 as illustrated in FIG. 21.

The hinge pressing member 133 has a first spring acting portion 135 having an L-shaped end, a U-shaped second spring acting portion 137, and a horizontal pressing portion 139 connecting the first spring acting portion 135 and the second spring acting portion 137. The L-shaped end portion of the first spring acting portion 135 comes into contact with an inner wall surface of the first recessed portion 127 on the base end side in the front panel 125, locking one end of the hinge pressing member 133. An end portion of the first cover portion 131 is held by a locking convex portion 142 provided in a base section of the first spring acting portion 135 and the horizontal pressing portion 139, and thus the hinge pressing member 133 is attached. An engagement groove 141 is provided in the U-shaped end portion of the second spring acting portion 137, and into the engagement groove 141, an end of the second cover portion 132 is fitted to lock the other end of the hinge pressing member 133.

The hinge pressing member 133 having the above-described structure is attached by being pressed from above with respect to the rotation base end portion of the access cover 13 that has been opened in a state in which the two recessed portions 127 and 128 and the two cover portions 131 and 132 are combined, and the hinge pressing member 133 is fixed with a relatively small force by snap-fit as illustrated in FIG. 21. Once the hinge pressing member 133 is fixed, the locking action by both ends of the hinge pressing member 133 and the locking convex portion 142 of the first spring acting portion 135 works, providing strong fixation to prevent the hinge pressing member 133 from readily being detached.

3. Operations of Printing Apparatus (See FIG. 1 to FIG. 21)

Operations of the printing apparatus 1 according to the above-described embodiment will be specifically described with the descriptions of (A) basic operations of the printing apparatus, (B) open and close operations of the access cover, (C) attachment and detachment operations of the container, (D) lock and unlock operations of the locking mechanism, and (E) an access cover attachment operation.

A. Basic Operations of Printing Apparatus (see FIG. 1 and FIG. 2)

The printing apparatus 1 according to the embodiment can perform an operation of reading an image on a document by using the scanner 3, a print operation to a medium P by using the printer body 4, and an operation of copying a document by using both the scanner 3 and the printer body 4.

In reading image information on a document, the cover 25 of the scanner 3 is opened to set the document on a document positioning plate, and an instruction is issued via the operation panel 63 or a personal computer (PC) to start the reading of the image information. In accordance with the instruction, an image sensor in the body section 27 starts scanning, and reading of the image information is performed. In performing printing to a medium P, the medium cassette 7 in which the media P are set is attached to the medium cassette mounting section 5, and an instruction is issued from a PC to start the printing. In accordance with the instruction, the media P is picked up one by one from the uppermost one by the pickup roller 35 and supplied to the printing area through the first feeding path 37 and the second feeding path 43 with the transportation force applied by the feeding roller 45 and the transport roller 47.

In the printing area, the inks to be supplied from the liquid storage pack Q through the liquid tubes 61 are discharged from the print head 57 mounted on the carriage 59 that reciprocates in the width direction X, which is the scanning direction, to perform desired printing, and after the printing, the medium P is discharged to the discharge stacker 51 with the transportation force applied by the discharging roller 53. In printing on both sides of the medium P, after printing has been performed on the front side of the medium P, the medium P is supplied to the reversing path 55, and printing is performed on the back side similarly to the front side. In copying a document, an original document to be copied is set on the document positioning plate of the scanner 3, and a copying instruction is issued via the operation panel 63 to start the copying. After the operation, the printing operation is performed to a medium P, and a copy image based on the image information read by the scanner 3 is output on the medium P.

B. Open and Close Operations of Access Cover (See FIG. 3, FIG. 4, FIG. 10, and FIG. 17 to FIG. 19)

To attach the liquid cassette 9 in which a liquid storage pack Q has been set to the liquid cassette mounting section 61, or to detach a used liquid storage pack Q from the liquid cassette mounting section 6 to replace it with a new liquid storage pack Q, the open and close operations of the access cover 13 are performed. To open the access cover 13 in a closed state, the user places a finger on the operation section 23, which protrudes from the opening 17 on the upper part of the left side of the liquid cassette mounting section 6 near the front side +Y, and presses the operation section 23 inward to release the locked state between the head portion 21*a* of the restriction portion 21 and the ribs 71 in the opening 17.

Then the user slides the operation section 23 in the unlock direction −S with the finger placed on the operation section 23, and the slide member 19 integrally moves in the unlock direction −S, releasing the locked state of the access cover 13 to become the unlocked state. After the operation, the user put a hand on a holding portion 14 in the central part of the rotation free end side of the access cover 13 and turns the access cover 13 downward toward the front, and then the access cover 13 is moved from the vertical closed position to the horizontal open position. In this operation, by the frictional force between the braking ribs 121 in the link arms 109 and the washers 117 urged by the compression coil springs 119, in the initial stage of the open operation, the access cover 13 smoothly rotates and just before the completion of the open operation, the access cover 13 slowly rotates, suppressing the impact noise at the completion of the open operation.

With the bearing structure 123 in which the rotation shaft 69 of the main body hinge section 65 is held by the first recessed portion 127, the first cover portion 132, and the first spring acting portion 135, the access cover 13 is rotated about the rotating shaft 69, and smoothly opened while being guided by the slide supporting point shaft 115 engaging with the engagement hole 113 in the link arm 109. To move the access cover 13 in the open state to the closed state, the user puts a hand on the holding portion 14 of the access cover 13 and turns the access cover 13 upward, and then the access cover 13 is moved from the horizontal open position to the vertical closed position in the reverse order of the open operation.

C. Attachment and Detachment Operations of Container (see FIG. 15 and FIG. 16)

To attach the large-capacity liquid cassette 9B for black (B) ink, which is a container, to the liquid cassette mounting section 6, the liquid cassette 9B to which the liquid storage pack Q containing the black (B) ink has been set is placed on the back side 13*b* of the access cover 13 that has been opened by the above-described operation as illustrated in FIG. 15. The liquid cassette 9B for black (B) ink is slid and inserted into the insertion slot 11B and pushed to the back while the left and right sides of the liquid cassette 9B are guided by the left and right guide ribs 107, and thus the attachment of the liquid cassette 9B for black (B) ink is completed as illustrated in FIG. 16.

The other three liquid cassettes 7C, 7M, and 7Y are lighter than the liquid cassette 7B, and accordingly, the liquid cassettes 7C, 7M, and 7Y can be held by hands, directly inserted into the insertion slots 11C, 11M, and 11Y, and pushed to the back, respectively, and thus the attachment is completed. To detach the liquid cassettes 7B, 7C, 7M, and 7Y, which are containers, from the liquid cassette mounting section 6, the user puts a finger on a finger placing section, or the like of the front panel of the individual liquid cassettes 7B, 7C, 7M, and 7Y, and pulls the liquid cassettes 7B, 7C, 7M, and 7Y toward the user, respectively, and thus the liquid cassettes 7B, 7C, 7M, and 7Y can be detached from the liquid cassette mounting section 6 respectively.

D. Lock and Unlock Operations of Locking Mechanism (see FIG. 3 to FIG. 12)

Figure 7:
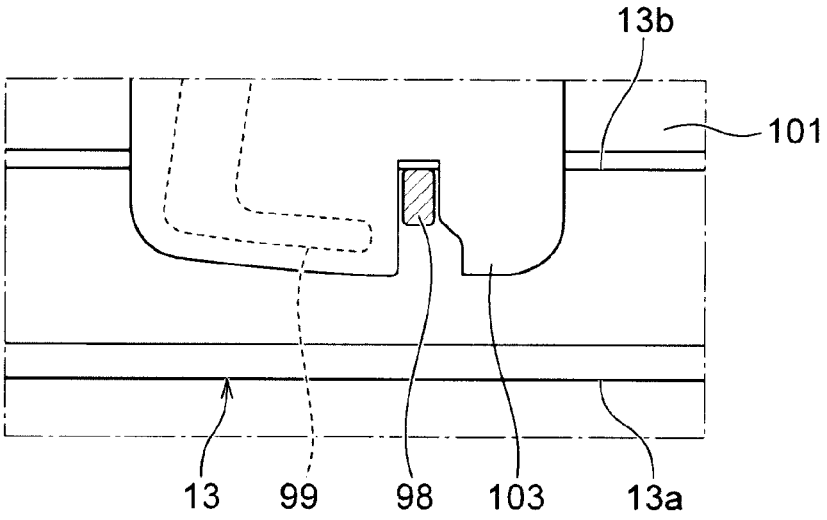
FIG. 7 is a plan view illustrating a positional relationship between an engagement hook and an engagement bar in a state in which the link mechanism in the printing apparatus according to the embodiment is in an unlocked state.
Figure 9:
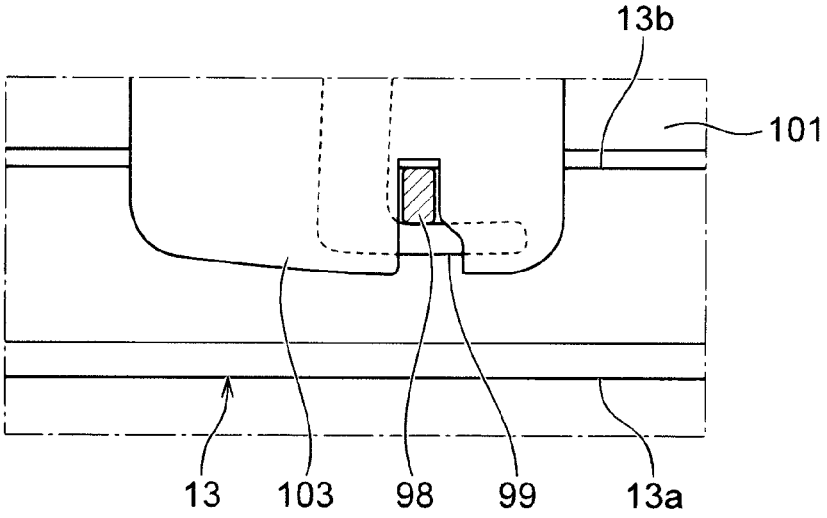
FIG. 9 is a plan view illustrating a positional relationship between the engagement hook and the engagement bar in a state in which the link mechanism in the printing apparatus according to the embodiment is in a locked state.

To move the locking mechanism 15 in the unlocked state illustrated in FIG. 3, FIG. 6, and FIG. 7 to the locked state illustrated in FIG. 4, FIG. 8, and FIG. 9, the user puts a finger on the operation section 23 and moves the locking mechanism 15 toward the user. When the slide member 19 reaches the lock position S1, the restriction portion 21 receives the urging force of the urging spring 79, which is the pressing member, to be released from the regulation by the ribs 71 on the other end side of the opening 17, and protrudes outward from the opening 17. When the slide member 19 is moved in the lock direction +S, the power is transmitted from the engaging claw portion 77 and the engagement receiving portion 95 in an engaged state to the swing link plate 91, and the swing link plate 91 swings about the pivot 89 in the clockwise direction in FIG. 9 against the urging force of the extension spring 94, which is an example urging member 93. With this operation, the engagement hook 99 in the swing link plate 91 is moved from the unlocked state in FIG. 7 to the locked state in FIG. 9, and thereby the engagement hook 99 engages with the engagement bar 98 in the engagement groove portion 97 and the locked state is provided.

On the other hand, to move the locking mechanism 15 in the locked state illustrated in FIG. 4, FIG. 8, and FIG. 9 to the unlocked state illustrated in FIG. 3, FIG. 6, and FIG. 7, the user puts a finger on the operation section 23 and pushes it inward, and moves the operation section 23 to the back side while placing the finger on the operation section 23. With this operation, the restriction portion 21 is released from the regulation by the ribs 71 and the slide member 19 can be moved in the unlock direction −S. When the restriction portion 21 is released from the regulation by the ribs 71, the swing link plate 91 automatically moves in the unlock direction −S by the urging force of the extension spring 94, and thus the swing link plate 91 smoothly swings. Then, the engagement hook 99 is moved from the locked state in FIG. 9 to the unlocked state in FIG. 7, and the engagement hook 99 becomes the unlocked state.

In a state in which the slide member 19 is in the lock position S1 as illustrated in FIG. 4, the head portion 21*a* of the restriction portion 21 protrudes outward from the opening 17 and thus the through hole 83 in the restriction portion 21 also protrudes outward from the apparatus. With this structure, when the lock 85 such as a padlock is used as a theft-prevention measure for the liquid storage packs Q, as illustrated in FIG. 5, the bar 85*a* of the lock 85 can be readily inserted into the through hole 83 of the restriction portion 21 protruding outward from the apparatus, and by locking the lock 85 with the bar 85*a*, a malicious unauthorized operation of opening the access cover 13 can be prevented.

E. Access Cover Attachment Operation (see FIG. 20 and FIG. 21)

To attach the access cover 13 to the front side of the liquid cassette mounting section 6, as illustrated in FIG. 20, the front panel 125 and the rear panel 129 of the access cover 13 are assembled in advance, the assembled access cover 13 is placed in a horizontal state with the back side 13*b* up as illustrated in FIG. 20, and the access cover 13 is brought toward the liquid cassette mounting section 6 while the position in the width direction X is being adjusted such that the bearing structure 123 is located at the position corresponding to the main body hinge section 65. Then, the rotation free end of the access cover 13 is slightly lifted upward to lower the position of a protrusion portion 127*a* that is a part of the first recessed portion 127 of the front panel 125 on the base end side such that the rotation shaft 69 of the main body hinge section 65 is fitted into the first recessed portion 127.

In this state, the rotation free end of the access cover 13 is lowered to place the access cover 13 in a horizontal position. Then, the hinge pressing member 133 is pressed from above to locate the first spring acting portion 135 in the first recessed portion 127 and the second spring acting portion 137 in the second recessed portion 128. In this process, by the spring action of the first spring acting portion 135 and the second spring acting portion 137, the end portion 136 of the first spring acting portion 135 and the engagement groove 141 of the second spring acting portion 137 are displaced inward respectively, and thus the attachment of the hinge pressing member 133 is completed with a relatively small force.

Once the hinge pressing member 133 is attached, the locking action by the end portion 136 of the first spring acting portion 135 and the protrusion portion 127*a* of the first recessed portion 127, the holding action by the locking convex portion 142, which is provided in the base section of the first spring acting portion 135, and the horizontal pressing portion 139, and the engaging action by the engagement groove 141 of the second spring acting portion 137 and the second cover portion 132 work, and thus the secure fixation of the access cover 13 with respect to the liquid cassette mounting section 6 is provided, and the access cover 13 is not readily detached.

4. Structure and Operation of Urging Member According to Modification (see FIG. 13, FIG. 22, and FIG. 23)

Figure 22:
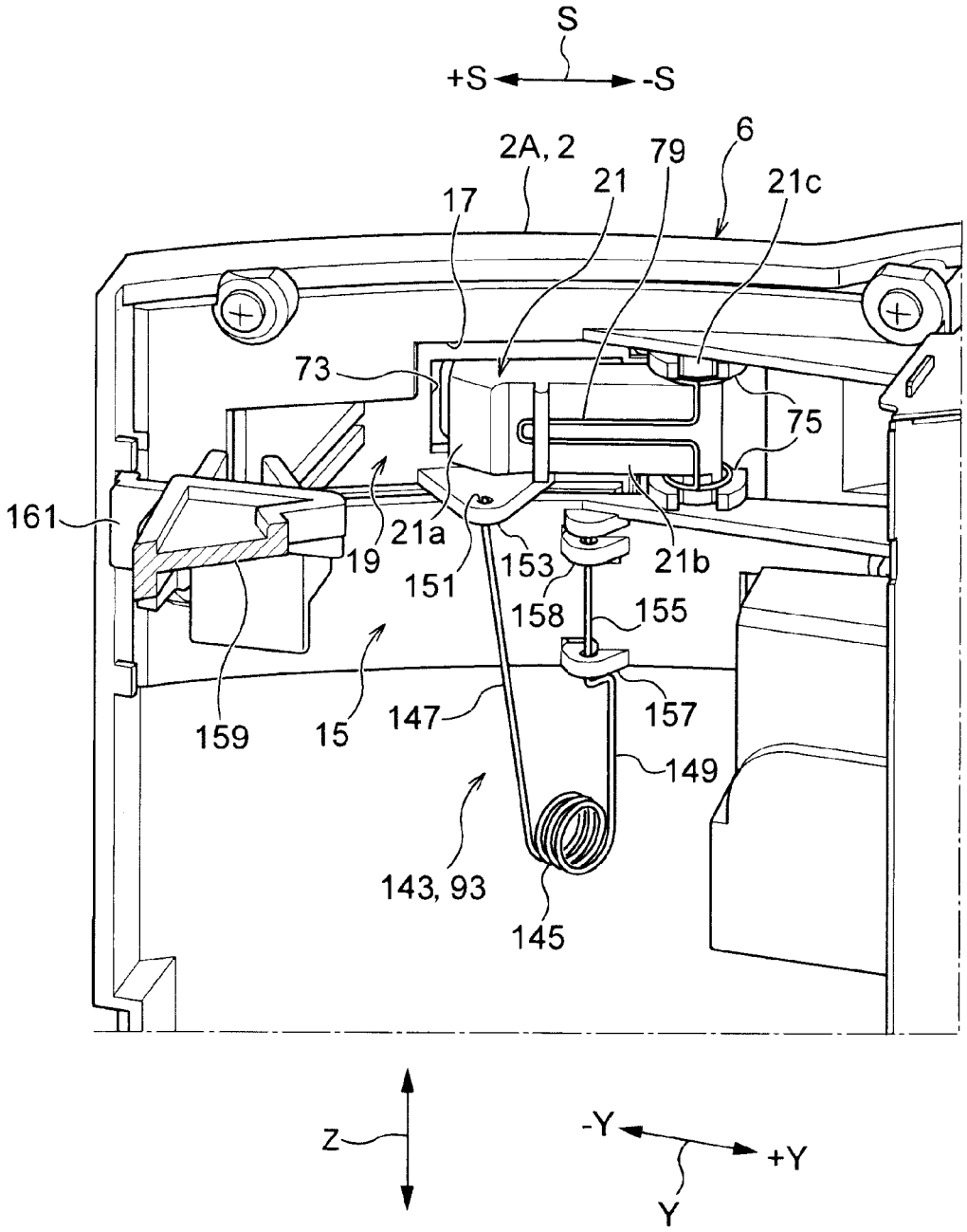
FIG. 22 is a perspective view illustrating the printing apparatus according to the embodiment viewed from a panel back side in the locked state in which a torsion spring is used as an urging member for the printing apparatus according to the embodiment.
Figure 23:
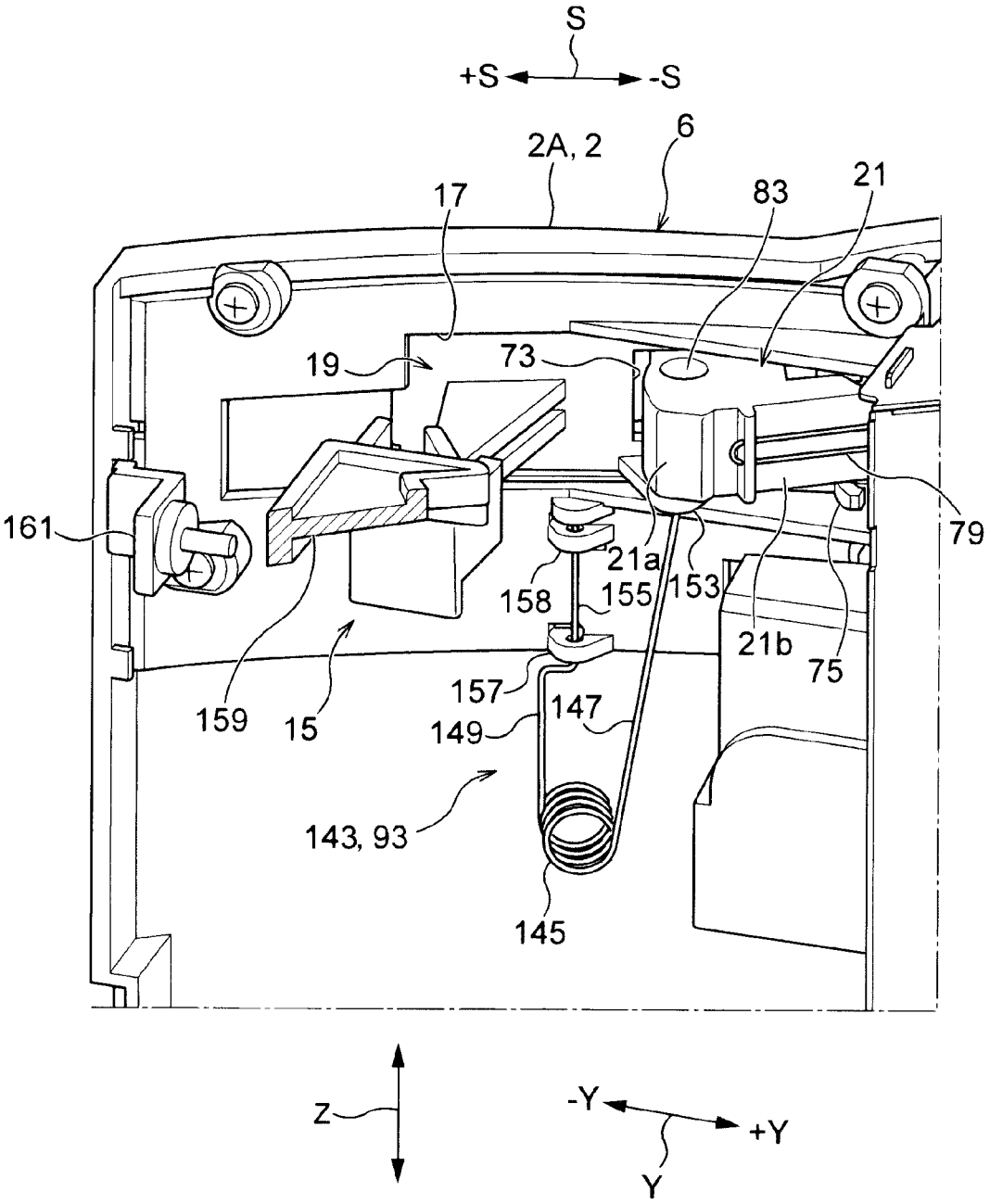
FIG. 23 is a perspective view illustrating the printing apparatus according to the embodiment viewed from the panel back side in the unlocked state in which the torsion spring is used as the urging member for the printing apparatus according to the embodiment.

The urging member 93 for smoothing the swing of the swing link plate 91 in the unlocking direction −S may be, instead of the extension spring 94 illustrated in FIG. 6 and FIG. 8, a torsion spring 143 illustrated in FIG. 22 and FIG. 23 may be used. Specifically, a torsion spring illustrated in FIG. 22 and FIG. 23 may be used as the torsion spring 143. The torsion spring 143 has a coil portion 145, a first locking portion 147 that extends straight from one end of the coil portion 145, and a second locking portion 149 having a straight portion that extends straight from the other end of the coil portion 145, a portion that is cranked, and a straight portion 155 that extends straight.

The slide member 19 has a locking piece 153 having a hole 151 into which an end portion of the first locking portion 147 is installed. On the back side of the outer casing 2A of the liquid cassette mounting section 6, two bearing portions 157 and 158 for supporting an upper end and a lower end of a rotation shaft, that is, the straight portion 155 from the cranked portion to the tip portion, are disposed.

When the torsion spring 143 having such a structure is used as the urging member 93, the position of the locking piece 153 that locks the end portion of the first locking portion 147 is changed depending on the slide position of the slide member 19, and the urging state of the torsion spring 143 is changed. Specifically, in a state in which the first locking portion 147 is located on the unlock direction −S side from a neutral position at which the straight portion 155 of the second locking portion 149 and the first locking portion 147 are balanced as illustrated in FIG. 23, an urging force works such that the swing link plate 91 is swung in the unlock direction −S. In a state in which the first locking portion 147 is located on the lock direction +S side as illustrated in FIG. 22, an urging force acts such that the swing link plate 91 is swung in the lock direction +S, and thus an unstable movement of the swing link plate 91 that will occur around the middle position in the swing range of the swing link plate 91 can be reduced.

5. Operations and Effects of Printing Apparatus

In the printing apparatus 1 according to the embodiment having such a structure and configured to perform the operations, when the locking mechanism 15 is locked, the through hole 83 for attaching the lock 85 is located outside the outer casing 2, enabling the user to readily attach the lock 85. With the large and rigid swing link plate 91 having the long working length L, the position for operating the locking mechanism 15 and the lock position can be located apart, and thus the slide member 19 can be provided without preventing the opening and closing of the access cover 13, and a reliable and secure closed state of the access cover 13 can be maintained.

By the braking force generated by the compression coil springs 119 between the link arms 109 and the slide supporting point shafts 115, the braking ribs 121, and the washers 117, the impact noise generated in opening or closing the access cover 13 can be suppressed. With the main body hinge section 65 on the liquid cassette mounting section 6 side and the bearing structure 123 on the access cover 13 side, the access cover 13 can be readily attached and after the attachment, the secure hinge section can be provided.

With the adjusted height of the back side 13*b* of the access cover 13 and the guiding operation by the guide ribs 107 on the back side of the access cover 13, the liquid cassette 9B can be readily attached to the insertion slot 11B in the lower part. Furthermore, with the urging member 93, that is, the extension spring 94 between the swing link plate 91 and the top plate 10 of the liquid cassette mounting section 6, the swing link plate 91 can be smoothly swung in the unlock direction −S. When the torsion spring 143 is disposed between the slide member 19 and the outer casing 2, an unstable movement of the swing link plate 91 that will occur around the middle position in the swing range of the swing link plate 91 can be reduced.

Other Embodiments

The printing apparatus 1 according to the embodiment of the present disclosure basically has the above-described structure; however, the structure may be partially modified or omitted without departing from the scope of the present disclosure.

For example, the printing apparatus 1 according to the present disclosure is not limited to the multifunction ink jet printer including the integrated printer body 4 and image reading apparatus 3 in the above-described embodiment; alternatively, a multifunction laser printer, a copying machine, or a single printing apparatus not having the image reading apparatus 3 and having only the printer body 4 may be employed. The print-related component Q is not limited to the liquid storage pack Q storing liquid such as ink, and may be a liquid cartridge or a liquid tank storing similar liquid. In addition, the print-related component Q may include various components relating to printing such as a medium P for printing, a waste liquid tank for collecting liquid such as ink not used in printing, and other replacement parts to be replaced necessary for printing in the printer body 4.

The structure having the different widths W in the opening 17 on the unlock position S2 side and the lock position S1 side is not limited to the structure having the opening 17 provided with the ribs 71; alternatively, the shape of the opening 17 may be a shape having different shapes on the unlock position S2 side and the lock position S1 side. Furthermore, the locking mechanism 15 may include only the slide member 19 and the restriction portion 21 without the link mechanism 87. In such a case, an engaging portion, or, for example, a lock operation portion 159 illustrated in FIG. 22 and FIG. 23 may be provided in the slide member 19, and when the slide member 19 is in the lock position S1, the engaging portion or the lock operation portion 159 may be engaged with an engagement receiving portion in the outer casing 2A, or the like. Alternatively, a lock operation receiving portion 161, or the like may be operated to drive the locking mechanism 15, or the like that is separately provided to regulate the open operation of the access cover 13. To ensure the locked state when the access cover 13 is closed, the locking mechanisms 15 having such a structure may be provided on each of the left and right sides of the outer casing 2A, that is, a total of two sets of the locking mechanisms 15 may be provided.

What is claimed is:

1. A printing apparatus comprising:

an insertion slot for detachably attaching a container of a print-related component which relates to a print performed by a print section;

an access cover that openably and closably covers the insertion slots; and a locking mechanism configured to lock the access cover, the locking mechanism comprising:

a slide member disposed inside an outer casing of the printing apparatus within an opening in the outer casing, the slide member being configured to move in a slide direction, wherein movement of the slide member in the slide direction changes a state of the access cover between a locked state and an unlocked state; and a restriction portion configured to be moved in the slide direction together with the slide member, wherein in the locked state, the slide member is in a lock position, which is on one end of the opening in the slide direction, the restriction portion protrudes from the opening, and the movement of the locking mechanism in the slide direction is regulated, in the unlocked state, the slide member is in an unlock position on the opposite end of the opening in the slide direction, the restriction portion is retracted inside the opening, and the movement of the locking mechanism in the slide direction is permitted, and the restriction portion includes an operation portion configured to move the slide member between the lock position and the unlock position wherein the operation portion is outside of the opening of the outer casing.

2. The printing apparatus according to claim 1, wherein a width of the opening in a direction intersecting the slide direction on the other end side is narrower than a width of the restriction portion to regulate the restriction portion not to protrude from the opening and regulate the movement in the slide direction of the restriction portion that is in the lock position on the one end side and protrudes from the opening, and a width of the opening in the direction intersecting the slide direction on the one end side is wider than a width of the restriction portion to permit the restriction portion to protrude from the opening.

3. The printing apparatus according to claim 1, wherein the restriction portion is configured to be slid with respect to the slide member, and the restriction portion includes a pressing member configured to press the restriction portion in a direction protruding from the opening in a state in which the slide member has been moved to the lock position.

4. The printing apparatus according to claim 1, wherein the operation portion is a protrusion, and a width of the opening in the direction intersecting the slide direction on the one other end side is wider than a width of the protrusion, and the protrusion always protrudes from the opening.

5. The printing apparatus according to claim 1, wherein the restriction portion has a through hole in the portion protruding from the opening.

6. The printing apparatus according to claim 1, further comprising:

a link mechanism configured to be moved in response to a movement of the slide member, wherein when the slide member is in the lock position, the link mechanism regulates the operation for opening the access cover.

7. The printing apparatus according to claim 6, wherein the link mechanism comprises a swing link plate configured to swing about a pivot within a predetermined angle range and has a long working length;

an urging member configured to urge the swing link plate in an unlock direction;

an engagement receiving portion provided in a portion of the swing link plate and is configured to engage with an engaging claw portion that is provided with respect to the slide member; and an engagement hook provided in a portion of the swing link plate and is configured to enter an engagement groove portion provided in the access cover and engage with an engagement bar that is disposed in the engagement groove portion.

8. The printing apparatus according to claim 1, wherein the slide member includes an engaging portion, and when the slide member is in the lock position, the engaging portion regulates the operation for opening the access cover.

* * * * *